US011803132B2

(12) United States Patent
Kayamori et al.

(10) Patent No.: US 11,803,132 B2
(45) Date of Patent: Oct. 31, 2023

(54) TONER FOR DEVELOPING AN ELECTROSTATIC CHARGE IMAGE AND AN IMAGE FORMING METHOD

(71) Applicant: Konica Minolta, Inc., Tokyo (JP)

(72) Inventors: Takanari Kayamori, Kanagawa (JP); Yuya Kubo, Tokyo (JP); Shiro Hirano, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 143 days.

(21) Appl. No.: 17/371,222

(22) Filed: Jul. 9, 2021

(65) Prior Publication Data

US 2022/0011686 A1 Jan. 13, 2022

(30) Foreign Application Priority Data

Jul. 13, 2020 (JP) ..... 2020-120016

(51) Int. Cl.

| | |
|---|---|
| ***G03G 9/09*** | (2006.01) |
| ***G03G 9/087*** | (2006.01) |
| ***G03G 9/097*** | (2006.01) |
| ***G03G 15/20*** | (2006.01) |
| ***G03G 9/08*** | (2006.01) |

(52) U.S. Cl.

CPC ..... *G03G 9/0906* (2013.01); *G03G 9/0819* (2013.01); *G03G 9/0821* (2013.01); *G03G 9/08711* (2013.01); *G03G 9/08755* (2013.01); *G03G 9/09708* (2013.01); *G03G 15/2014* (2013.01)

(58) Field of Classification Search

CPC ... G03G 9/0904; G03G 9/0918; G03G 9/0926

See application file for complete search history.

(56) References Cited

U.S. PATENT DOCUMENTS

| | | | | |
|---|---|---|---|---|
| 2012/0082926 | A1* | 4/2012 | Suzuki | G03G 9/0924 430/105 |
| 2014/0134529 | A1* | 5/2014 | Yamada | G03G 9/0922 430/107.1 |
| 2015/0338756 | A1* | 11/2015 | Yamada | G03G 9/122 430/108.1 |
| 2019/0033740 | A1* | 1/2019 | Iguchi | G03G 9/0819 |

FOREIGN PATENT DOCUMENTS

| | | | |
|---|---|---|---|
| JP | H05-297635 | A | 11/1993 |
| JP | 2009-079096 | A | 4/2009 |
| JP | 2011-065076 | A | 3/2011 |
| JP | 2012-083440 | A | 4/2012 |
| JP | 2015-176088 | A | 10/2015 |

* cited by examiner

*Primary Examiner* — Peter L Vajda

(74) *Attorney, Agent, or Firm* — LUCAS & MERCANTI, LLP

(57) ABSTRACT

The toner for developing an electrostatic charge image of the present invention contains a toner base particle comprising a binder resin and at least two kinds of organic pigments, and strontium titanate as an external additive.

12 Claims, 1 Drawing Sheet

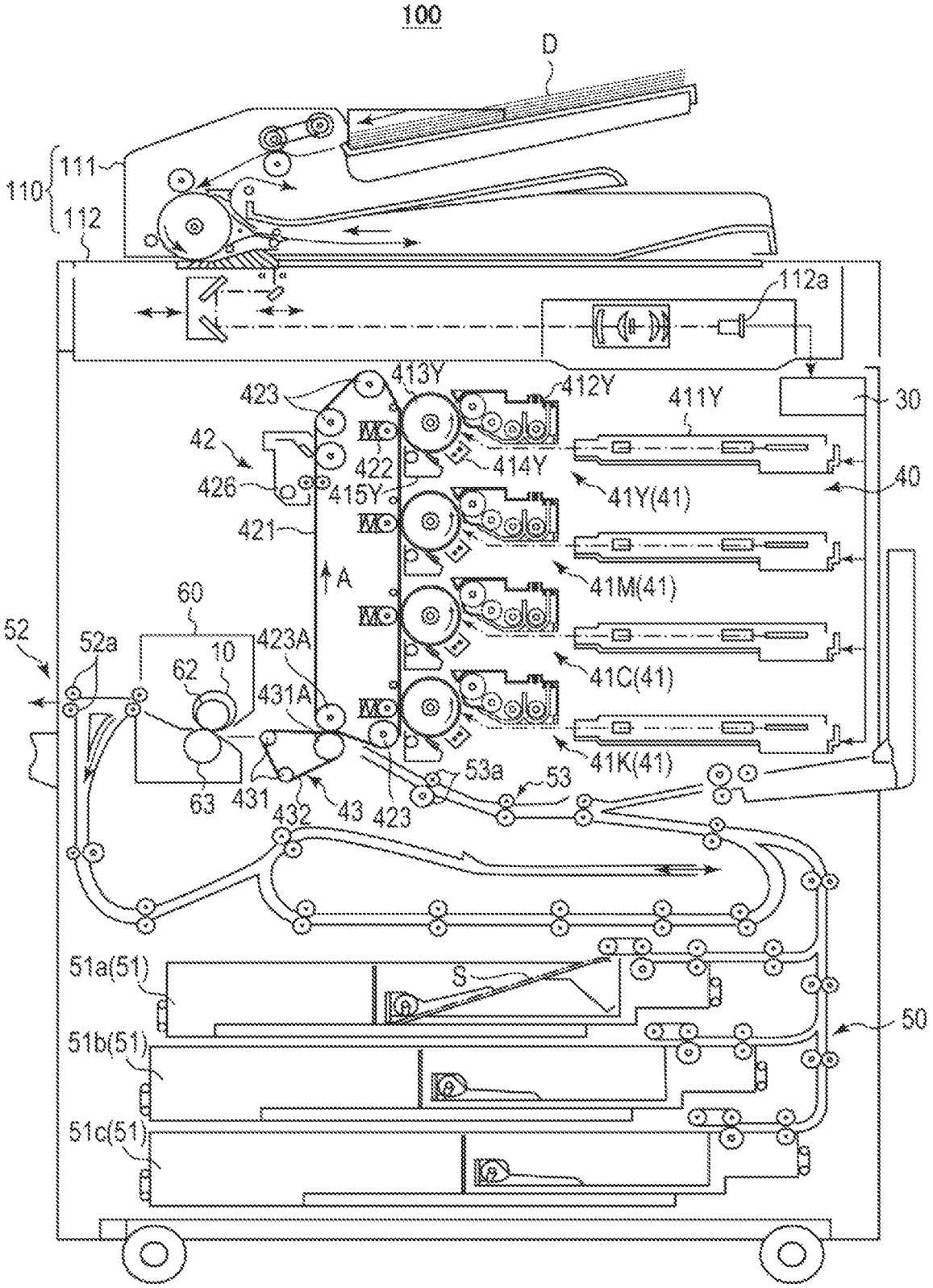
100
D
110
111
112
112a
30
423
413Y
412Y
411Y
42
422
414Y
426
415Y
41Y(41)
40
421
A
41M(41)
60
52
52a
10
423A
62
431A
41C(41)
41K(41)
53a
53
63
431
432
43
423
51a(51)
S
50
51b(51)
51c(51)

TONER FOR DEVELOPING AN ELECTROSTATIC CHARGE IMAGE AND AN IMAGE FORMING METHOD

CROSS REFERENCE TO RELATED APPLICATIONS

The entire disclosure of Japanese Patent Application No. 2020-120016 filed on Jul. 13, 2020, is incorporated herein by reference in its entirety.

BACKGROUND

Technological Field

The present invention relates to a toner for developing an electrostatic charge image and an image forming method.

Description of Related Art

Toners are known in which a plurality of kinds of organic pigments are internally added into one toner base particle for the purpose of adjusting the color tone to be formed, adjusting the physical properties of the toner, improving the dispersibility of the pigment, or the like (Japanese Patent Laid-Open No. 2015-176088, Japanese Patent Laid-Open No. 2011-065076, and Japanese Patent Laid-Open No. 2012-083440).

Also known is a toner in which organic pigments of different color tones are internally added into one toner base particle so that light in a wide wavelength range can be absorbed. Typically, the above type of toner absorbs electromagnetic waves in the visible light region well, but the amount of absorption of electromagnetic waves in the near infrared region is small. Thus, the above toner can be used for forming an image which is black in appearance but is observed as transparent when a detector having sensitivity only to near infrared rays is used. With such characteristics, the above toner can be used for forming an image to which a region having transparency to near infrared rays is partially imparted. The imparted near-infrared transparent region can be used as a hidden information which cannot be recognized by a person's eye (for example, JP-A-5-297635 and JP-A-2009-79096).

Since carbon black absorbs electromagnetic waves in the near infrared region, the above transparency to the near infrared rays cannot be achieved by a toner containing carbon black as a pigment (Japanese Patent Application Laid-Open No. 2009-79096).

SUMMARY

As described above, a toner in which a plurality of kinds of organic pigments are internally added into one toner base particle is known. However, according to the findings of the present inventors, such a toner has insufficient chargeability or insufficient cleanability after image formation.

In view of the above problems, it is an object of the present invention to provide a toner in which while a plurality of kinds of organic pigments are internally added into one toner base particle, the toner has a higher charging property and a cleanability, and an image forming method using the toner.

In order to realize the above object, a toner for developing an electrostatic charge image reflecting one aspect of the present invention has toner base particles and an external additive. The toner base particles include a binder resin and at least two kinds of organic pigments, and the external additive includes strontium titanate.

BRIEF DESCRIPTION OF DRAWINGS

The advantageous and features provided by one or mom embodiments of the invention will become more fully understood from the detailed description given hereinbelow and the appended drawing which are given by way of illustration only, and thus are not intended as a definition of the limits of the present invention:

FIG. 1 is a schematic configuration diagram illustrating an example of an image forming apparatus relating to the present embodiment;

DETAILED DESCRIPTION OF EMBODIMENTS

Hereinafter, one or more embodiments of the present invention will be described with reference to the drawing. However, the scope of the invention is not limited to the disclosed embodiments.

1. Toner for Developing Electrostatic Charge Image

One embodiment of the present invention relates to a toner for developing an electrostatic charge image (electrostatic latent image) formed on an image carrier such as a photoreceptor. The above toner may be a one component developer or a two components developer containing carrier particles and toner particles.

The toner has toner base particles and an external additive adhering to the surface of the toner base particles. The toner base particles contain a binder resin and at least two kinds of organic pigments. The external additive contains strontium titanate.

According to the findings of the present inventors, when a toner contains two or mom kinds of organic pigments, the total amount of the organic pigment in one toner base particles tends to become large, accompanied with the increase in the type of organic pigment. In addition, when organic pigments having a large resistance increases, the charging property of the toner becomes unstable as the amount of the organic pigments becomes large. Then, because of the unstable charging property, the toner may be excessively charged in a low temperature and low humidity (LL) environmental condition. As a result, the amount of charge of the toner greatly changes depending on the environmental conditions (for example, the difference in the environmental conditions between the LL environmental conditions and the high temperature and high humidity (HH) environmental conditions in which the excessive charging of the toner does not occur so easily), and thus stability for image forming is decreased.

On the other hand, strontium titanate contained as an external additive in the above toner has a lower resistance compared with other substances (for example, silica, and the like) used as an external additive. Thus, strontium titanate acts as a resistance adjusting agent in the above toner, by which excessive charging of the toner, occurred as a result of increment of electric resistance due to the increment of the amount of the pigments, can be suppressed. As such, strontium titanate is considered to stabilize the charging property of the toner and enables stable image formation.

In addition, strontium titanate has high positive charging property. Thus, strontium titanate, which has been dropped off from by the toner base particles due to friction of the toner particles at the time of development, is imparted with a polarity opposite to that of the toner due to the above friction. The dropped-off strontium titanate thus moves to and collects in non-image portion where the toner particles do not exist, and remains on the image carrier without being transferred to the recording medium. Then, the remained strontium titanate accumulates between the cleaning member and the image carrier, thereby preventing leakage of the toner from the cleaning member. As such, strontium titanate is considered to further enhance the cleaning property of the toner.

Hereinafter, the toner of the present invention based on the above technical concept will be described in more detail.

1-1. Toner Base Particles

The toner base particles have a binder resin and two or more kinds of organic pigments.

The toner base particles preferably have an average particle diameter on a volume basis of 5.0 μm or more and 8.0 μm or less, and more preferably 5.5 μm or more and 7.0 μm or less. By setting the average particle diameter on a volume basis of the toner base particles to 5.0 μm or more, the two or more kinds of pigments can be sufficiently internally added to the toner base particles thereby a good color developability can be obtained, and transfer efficiency of the toner can be increased. By setting the average particle diameter on a volume basis of the toner base particles to 8.0 μm or less, the resolution of the image to be formed can be further increased.

The average particle diameter on a volume basis of the toner base particles can be measured using a measuring device in which a computer system equipped with a soft Software V3.51 for data processing is connected to a particle size distribution measuring device (manufactured by Beckman Coulter Co., Ltd., Coulter Multisizer 3). Specifically, 0.02 g of a sample (toner base particles) is added to 20 mL of a surfactant solution (a surfactant solution for dispersing toner particles, obtained by diluting, for example, a neutral detergent containing a surfactant component 10 times with pure water) and adapted, and then subjected to an ultrasonic dispersion treatment for 1 minutes to prepare a dispersion of toner base particles. The dispersion is pipetted into a beaker containing an electrolyte (Beckman Coulter, ISOTONII) in the sample stand until the indicated density of the measuring device is 8% By setting this concentration, reproducible measurement values can be obtained. Then, in the measuring device, the number of measured particle counts is set to 25000 and the aperture diameter is set to 100 μm, and a measurement range of 2 to 60 μm is divided into 256 to calculate each frequency value, and based on this, an average particle diameter on a volume basis is calculated.

1-1-1. Binder Resin

The binder resin is preferably a thermoplastic resin.

Examples of the thermoplastic resins include styrene resins, vinyl resins (such as acrylic resins and styrene-acrylic resins), polyester resins, silicone resins, olefin resins, polyamide resins, and epoxy resins.

The binder resin may be an amorphous resin or a crystalline resin.

(Amorphous Resin)

In this specification, an amorphous resin means a resin in which a melting point is not observed in measurement by differential scanning calorimetry (DSC: Differential Scanning Calorimetry). In this specification, when a melting point is observed in a resin, it means that a peak in which a half width of an endothermic peak is within 15° C. is observed when measured at a temperature rise rate of 10° C./min in DSC.

When the glass transition temperature observed in the first temperature rise process in DSC measurement is set as a $Tg_1$ and the glass transition temperature observed in the second temperature rise process is set as a $Tg_2$, the amorphous resin preferably has a $Tg_1$ of 35° C. or more and 80° C. or less, and more preferably 45° C. or more and 65° C. or less. In addition, the amorphous resin preferably has a $Tg_2$ of 20° C. or more and 70° C. or less, more preferably 30° C. or more and 55° C. or less. When $Tg_1$ of the amorphous resin is 35° C. or more or $Tg_2$ is 20° C. or more, heat resistance (heat-resistant storage property, and the like) of the toner can be further increased. When $Tg_1$ of the amorphous resin is 80° C. or less or $Tg_2$ is 70° C. or less, low-temperature fixability of the toner can be further increased.

In this specification, the glass transition temperature (Tg) of the resin can be a value measured using a known DSC measuring machine (for example. Diamond DSC manufactured by Perkin Elmer Co., Ltd.). Specifically, 3.0 mg of the measurement sample (resin) is enclosed in an aluminum pan and set in a sample holder of a DSC measuring machine. Use empty aluminum bread for reference. Then, by the measurement conditions (heating and cooling conditions) of: a first heating process of raising the temperature from 0° C. at a heating rate of 10° C./min until 200° C.; a cooling process of cooling from 200° C. at a cooling rate of 10° C./min until 0° C. and a second heating process of raising the temperature from 0° C. at a heating rate of 10° C./min until 200° C., are conducted through this order to obtain DSC curves. Based on the obtained DSC curves, an extension line of the baseline prior to the rise of the first endothermic peak in the respective temperature rise process and a tangent line indicating a maximum slope between the rising portion of the first peak and the peak apex are drawn, and the intersection point thereof is defined as the glass transition temperature ($Tg_1$ and $Tg_2$)

The content of the amorphous resin is preferably 20% by mass or more and 99% by mass or less, more preferably 30% by mass or more and 95% by mass or less, and still more preferably 40% by mass or more and 90% by mass or less, based on the total mass of the toner base particles. When the content of the amorphous resin is 20% by mass or more, the intensity of the image to be formed can be further increased.

Examples of the above-mentioned amorphous resins include styrene resins, vinyl resins, olefin resins, epoxy resins, amorphous polyester resins, polyurethane resins, polyamide resins, cellulose resins, and polyether resins. One kind of these resins may be used alone, or two or more kinds thereof may be used in combination. Of these, amorphous polyester resins and vinyl resins such as styrene-acrylic resins are preferred.

The amorphous polyester resin can enhance the low-temperature fixability of the toner. The amorphous polyester resin may be any amorphous resin obtained by a polycondensation reaction of a carboxylic acid having two or more valences (polyvalent carboxylic acid) and an alcohol having two or more valences (polyhydric alcohol). Examples of the polyvalent carboxylic acid include unsaturated aliphatic polyvalent carboxylic acids, aromatic polyvalent carboxylic acids, and derivatives thereof. As long as the obtained polyester resin becomes amorphous, a saturated aliphatic polyvalent carboxylic acid may be used in combination. Examples of the above polyhydric alcohol include unsaturated aliphatic polyhydric alcohols, aromatic polyhydric alcohols, and derivatives thereof. As long as the obtained polyester resin becomes amorphous, a saturated aliphatic poly hydric alcohol may be used in combination. The polyhydric fatty acids and polyhydric alcohols may be used alone or as a mixture of two or more thereof.

The vinyl resin can harden the toner base particles to suppress the burial of the external additive into the toner base particles, and thereby enhance the improvement effect of the charging property and improvement effect of the cleaning property, each caused by strontium titanate Examples of the vinyl resins include (co)polymers of (meta) acrylic acid ester having straight-chain hydrocarbons of 6 to 30 carbon atoms, styrene (co)polymers, (co)polymers of other (meta)acrylic acid esters, (co)polymers of vinyl esters, (co)polymers of vinyl ethers, (co)polymers of vinyl ketones, and (co)polymers of acrylic acid or metallic acid.

The content of the vinyl resin is preferably 0.1% by mass or more and 20% by mass or less based on the total mass of the binder resin. When the content of the vinyl resin is 0.1% by mass or more, the effect of suppressing burial of the external additive is sufficiently exhibited. When the content of the vinyl resin is 20% by mass or less, the content of the other resin (particularly, an amorphous polyester resin) can be increased to easily enhance the low-temperature fixability of the toner.

(Crystalline Resin)

In this specification, a crystalline resin means a resin in which a melting point is observed in measurement by DSC.

The crystalline resin enhances the flexibility of the toner base particles and thereby enhances the bindability of strontium titanate particles contained in the external additive.

The content of the crystalline resin is preferably 3% by mass or more and 30% by mass or less, more preferably 5% by mass or more and 20% by mass or less, based on the total mass of the toner base particles. When the content of the amorphous resin is 3% by mass or more, the fixability of the toner can be further increased.

Examples of the crystalline resins include styrene resins, vinyl resins, olefin resins, epoxy resins, amorphous polyester resins, polyurethane resins, polyamide resins, cellulose resins, and polyether resins. One kind of these resins may be used alone, or two or more kinds thereof may be used in combination. Of these, amorphous polyester resins and vinyl resins such as styrene-acrylic resins are preferred.

The crystalline polyester resin can enhance the low-temperature fixability of the toner. The crystalline polyester resin may be any crystalline resin obtained by a polycondensation reaction of a carboxylic acid having two or more valences (polyvalent carboxylic acid) and an alcohol having two or more valences (polyhydric alcohol).

The polyvalent carboxylic acid can be selected from: a two valent aliphatic dicarboxylic acid including oxalic acid, succinic acid, glutaric acid, adipic acid, speric acid, azelaic acid, sebacic acid, 1,9-nonanedicarboxylic acid, 1,10-decanedicarboxylic acid, dodecanedicarboxylic acid (1,12-dodecanedicarboxylic acid), 1,14-tetradecanedicarboxylic acid, 1,18-octadecanedicarboxylic acid, and the like; and a two valent aromatic dicarboxylic acid including phthalic acid, isophthalic acid, terephthalic acid, naphthalene-2,6-dicarboxylic acid, malonic acid, mesaconic acid, and the like. These polyvalent carboxylic acids may be anhydrides or lower alkyl esters.

Alternatively, the above polyvalent carboxylic acid may be a carboxylic acid having three or more valences such as 1,2,4-benzenetricarboxylic acid, 1,2,5-benzenetricarboxylic acid, 1,2,4-naphthalenetricarboxylic acid, and the like, and an anhydride or a lower alkyl ester thereof. Further, unsaturated polyvalent carboxylic acids including maleic acid, fumaric acid, 3-hexenedioic acid, and 3-octenedioic acid and the like may be used.

The polyhydric alcohol is preferably an aliphatic diol, and more preferably a linear aliphatic diol having 7 or more and 20 or less carbon atoms in the main chain portion. In particular, the linear aliphatic diol easily enhances the crystallinity of the polyester resin and hardly lowers the melting temperature. Thus, the linear aliphatic diol can further enhance the blocking resistance, the image storage property, and the low-temperature fixability of the toner. When the number of carbon atoms of the linear aliphatic diol is 7 or more and 20 or less, the melting point at the time of polycondensation with the polyvalent carboxylic acid component can be made lower, and synthesis becomes easier.

Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, and 1,18-octadecanediol. Alternatively, an alcohol having 3 or more valences including glycerin, trimethylolethane, trimethylolpropane, pentaerythritol, and the like may be used.

The weight average molecular weight of the crystalline polyester resin is preferably 5.000 or more and 50,000 or less. Note that, in this specification, the weight average molecular weight of the crystalline polyester resin is a value measured by gel permeation chromatography (GPC), for example, by the following method.

Tetrahydrofuran (THF) is flowed as a carrier solvent at a flow rate of 0.2 mL/min while using HLC-8120GPC manufactured by Tosoh Corporation as a device and TSKguardcolumn+TSKgelSuperHZ-M3 ream manufactured by Tosoh Corporation as a column and holding the column temperature at 40° C. As the measurement sample (resin), a solution dissolved in tetrahydrofuran so as to have a concentration of 1 mg/ml is used. The solution can be obtained by treatment with an ultrasonic disperser at room temperature for 5 minutes and then with a membrane filter with a pore size of 0.2 μm, 10 μL of this sample solution is injected into the apparatus together with the carrier solvent and detected using a refractive index detector (RI detector). The molecular weight distribution of the measurement sample is calculated based on a calibration curve generated using monodisperse polystyrene stand and particles.

1-1-2. Organic Pigment

The organic pigment is a pigment composed of an organic compound. In this embodiment, for the purpose of adjusting the color to be developed and adjusting the physical properties of the toner, two or more kinds of pigments are internally added into one toner base particle.

From the viewpoint of absorbing electromagnetic waves of a wider wavelength in the visible light region and further reducing the visibility of the image as an image having higher black color, it is preferable that the two or more kinds of pigments be pigments which exhibit different color tones from each other. More specifically, it is preferable that the two or more kinds of pigments include a combination of organic pigments having a difference in absorption maximum wavelength λ max of 50 nm or more and 240 nm or less.

In this specification, the absorption maximum wavelength of the organic pigment is measured by: obtaining a dispersion by mixing 0.02 parts by weight of the organic pigment per 100 parts by weight of methyl ethyl ketone; the obtained dispersion is placed in a quartz cell for a spectrophotometer having an optical path length of 10 mm; the absorption spectrum is measured in a wavelength range of 400-700 nm by a spectrophotometer, and a value which becomes an absorption maximum was set as an absorption maximum wavelength.

From the viewpoint of sufficiently absorbing electromagnetic waves of a wider wavelength in the visible light region, it is preferable that the two or more organic pigments include, when a visible light region (400 nm to 700 nm) is divided into two regions, a pigment P1 having an absorption maximum wavelength λ max in a short wavelength side region (a region in which a wavelength is larger than 400 nm and less than 600 nm), and a pigment P2 having an absorption maximum wavelength λ max in a long wavelength side region (a region in which a wavelength is 600 nm or more and 700 nm or less).

Further, among a pigment P1-1 in which an absorption maximum wavelength λ max is larger than 400 nm and less than 460 nm, a pigment P1-2 in which an absorption maximum wavelength λ max is equal to or larger than 460 nm and equal to or smaller than 530 nm, and a pigment P1-3 in which an absorption maximum wavelength λ max is larger than 530 nm and smaller than 600 nm, it is preferable that the pigment P1 contains at least a pigment P1-2.

From the viewpoint of sufficiently absorbing electromagnetic waves having a wider wavelength in the visible light region by appropriately combining these pigments, the pigment P1-1 is preferably a pigment having an absorption maximum wavelength λ max of greater than 410 nm and less than 450 nm, and the pigment P1-2 is preferably a pigment having an absorption maximum wavelength λ max of greater than or equal to 480 nm and less than or equal to 510 nm, and the pigment P1-3 is preferably a pigment having an absorption maximum wavelength λ max of greater than 540 nm and less than 590 nm, and the pigment P2 is preferably a pigment having an absorption maximum wavelength λ max of greater than or equal to 620 nm and less than or equal to 660 nm.

The pigment P1-2 is a pigment having an absorption maximum wavelength λ max in a central wavelength region of a wavelength region (400 nm to 600 nm) in which the pigment P1 may have an absorption maximum wavelength. Therefore, when the toner base particles contain the pigment P1-2, the image to be formed tends to absorb electromagnetic waves having a wider wavelength. In addition, the pigment P1-2 is often a pigment having low resistance, and it hardly causes a decrease in charging property due to excessive charging of the toner.

From the viewpoint of sufficiently absorbing electromagnetic waves having a wider wavelength in the visible light region, it is preferable that the pigment P1-2 has a half-value wavelength of 550 nm or more on the long wavelength side of the absorption spectrum.

Pigment P1-2 can be pigments such as monoazo pigments, disazo pigments, condensed azo pigments, naphthol AS pigments, benzimidazolone pigments, and the like. Specifically, the pigment P1-2 may be C.I. Pigment Brown 23, C.I. Pigment Brown 25. C.I. Pigment Brown 41, and C.I. Pigment Red 38, and the like.

On the other hand, from the viewpoint of more sufficiently absorbing electromagnetic waves having a wider wavelength in the visible light region, the toner base particles preferably include two or more of the pigment P1-1 to the pigment P1-3, and more preferably include all types thereof. In particular, when the toner base particles contain more kinds of pigments among the pigment P1-1 to the pigment P1-3, the charging property can be further stabilized and the fixability to the recording medium can be further increased. Further, even if any of the pigments fades, the other pigment can cover the wavelength range of the faded pigment, so that the light resistance of the formed image can be further increased. Further, according to the findings of the present inventors, the more the type of pigment, the higher the toner fixability, probably due to the higher dispersibility of the crystalline resin (particularly, a crystalline polyester resin).

The pigment P1-1 may be a monoazo pigment, a disazo pigment, a benzimidazoline pigment, an isoindolinone pigment, an isoindoline pigment and a perinone pigment, and the like. Specifically, the pigment P1-1 may be C.I. Pigment Yellow 1, C.I. Pigment Yellow 3, C.I. Pigment Yellow 12, C.I. Pigment Yellow 13, C.I. Pigment Yellow 14, C.I. Pigment Yellow 16, C.I. Pigment Yellow 17, C.I. Pigment Yellow 73. C.I. Pigment Yellow 74. C.I. Pigment Yellow 81, C.I. Pigment Yellow 83, C.I. Pigment Yellow 87, C.I. Pigment Yellow 97. C.I. Pigment Yellow 111, C.I. Pigment Yellow 120. C.I. Pigment Yellow 126. C.I. Pigment Yellow 127. C.I. Pigment Yellow 128, C.I. Pigment Yellow 139. C.I. Pigment Yellow 151. C.I. Pigment Yellow 154. C.I. Pigment Yellow 155, C.I. Pigment Yellow 173. C.I. Pigment Yellow 174. C.I. Pigment Yellow 175. C.I. Pigment Yellow 176, C.I. Pigment Yellow 180. C.I. Pigment Yellow 181, C.I. Pigment Yellow 185. C.I. Pigment Yellow 191, C.I. Pigment Yellow 194. C.I. Pigment Yellow 196. C.I. Pigment Yellow 213, C.I. Pigment Yellow 214, C.I. Pigment Yellow 217. C.I. Pigment Green 7. C.I. Pigment Green 36, C.I. Pigment Green 254, and C.I. Pigment Orange 43, and the like.

Of these, as the pigment P1-1. C.I. Pigment Yellow 74. C.I. Pigment Yellow 120. C.I. Pigment Yellow 139. C.I. Pigment Yellow 151. C.I. Pigment Yellow 155. C.I. Pigment Yellow 180. C.I. Pigment Yellow 181. C.I. Pigment Yellow 185. C.I. Pigment Yellow 213. C.I. Pigment Green 7. C.I. Pigment Green 36, and C.I. Pigment Green 254 are preferred.

The pigment P1-3 may be a monoazo pigment, a disazo pigment, a β-naphthol pigment, a naphthol AS pigment, an azolake pigment, a benzimidazolone pigment, an anthantron pigment, an anthraquinone pigment, a quinacridone pigment, a dioxazine pigment, a perylene pigment, a thioindigo pigment, a triarylcarbonium pigment and a diketopyrrolopyrrole pigment, and the like. Specifically, pigments P 1-3 nay be C.I. Pigment Orange 5. C.I. Pigment Orange 13. C.I. Pigment Orange 34. C.I. Pigment Orange 36. C.I. Pigment Orange 38. C.I. Pigment Orange 43. C.I. Pigment Orange 62. C.I. Pigment Orange 68. C.I. Pigment Orange 70. C.I. Pigment Orange 72. C.I. Pigment Orange 74. C.I. Pigment Red 2. C.I. Pigment Red 3. C.I. Pigment Red 4. C.I. Pigment Red 5. C.I. Pigment Red 9. C.I. Pigment Red 12. C.I. Pigment Red 14. C.I. Pigment Red 31. C.I. Pigment Red 48:2. C.I. Pigment Red 48:3. C.I. Pigment Red 48:4. C.I. Pigment Red 53:1. C.I. Pigment Red 57:1. C.I. Pigment Red 112. C.I. Pigment Red 122. C.I. Pigment Red 144. C.I. Pigment Red 146. C.I. Pigment Red 147. C.I. Pigment Red 149. C.I. Pigment Red 150. C.I. Pigment Red 168. C.I. Pigment Red 169. C.I. Pigment Red 170. C.I. Pigment Red 175. C.I. Pigment Red 176. C.I. Pigment Red 177. C.I. Pigment Red 179. C.I. Pigment Red 181. C.I. Pigment Red 184. C.I. Pigment Red 185. C.I. Pigment Red 187. C.I. Pigment Red 188. C.I. Pigment Red 207. C.I. Pigment Red 208. C.I. Pigment Red 209. C.I. Pigment Red 210. C.I. Pigment Red 214. C.I. Pigment Red 238. C.I. Pigment Red 242. C.I. Pigment Red 247. C.I. Pigment Red 253. C.I. Pigment Red 254. C.I. Pigment Red 256. C.I. Pigment Red 257. C.I. Pigment Red 262. C.I. Pigment Red 263. C.I. Pigment Red 266. C.I. Pigment Red 269. C.I. Pigment Red 274. C.I. Pigment Violet 19. C.I. Pigment Violet 23, and C.I. Pigment Violet 32, and the like.

Of these, as the pigment P1-3, C.I. Pigment Orange 34. C.I. Pigment Orange 36. C.I. Pigment Orange 38. C.I. Pigment Orange 43. C.I. Pigment Orange 62. C.I. Pigment Orange 68. C.I. Pigment Orange 70. C.I. Pigment Orange 72. C.I. Pigment Orange 74. C.I. Pigment Red 31. C.I. Pigment Red 48:4. C.I. Pigment Red 57:1. C.I. Pigment Red 122. C.I. Pigment Red 146. C.I. Pigment Red 147. C.I. Pigment Red 150. C.I. Pigment Red 184. C.I. Pigment Red 238. C.I. Pigment Red 242. C.I. Pigment Red 254. C.I. Pigment Red 269. C.I. Pigment Violet 19. C.I. Pigment Violet 23. And C.I. Pigment Violet 32 are preferred. Pigment P2 may be C.I. Pigment Blue 15, C.I. Pigment Blue 15:1, C.I. Pigment Blue 15:2. C.I. Pigment Blue 15:3. C.I. Pigment Blue 15:4, C.I. Pigment Blue 15:5, C.I. Pigment Blue 15:6, C.I. Pigment Blue 16. C.I. Pigment Blue 56, C.I. Pigment Blue 60, C.I. Pigment Blue 61, and C.I. Pigment Blue 80, and the like.

Of these, from the viewpoint of making the hue better, further enhancing the conductivity and light resistance, and hardly reducing the transmittance of electromagnetic waves in the near-infrared region, the pigment P2 is preferably a phthalocyanine pigment. Examples of pigment P2 which is a phthalocyanine pigment include C.I. Pigment Blue 15. C.I. Pigment Blue 15:1. C.I. Pigment Blue 15:2, C.I. Pigment Blue 15:3. C.I. Pigment Blue 15:4, C.I. Pigment Blue 15:5. C.I. Pigment Blue 15:6 and C.I. Pigment Blue 16, and the like.

The total content of the above pigments is preferably 1% by mass or more and 30% by mass or less, more preferably 5% by mass or more and 20% by mass or less, and still more preferably 7% by mass or more and 20% by mass or less, based on the total mass of the toner base particles. By increasing the content of the pigments, it is possible to further improve the color developability of the image to be formed. On the other hand, when the total content of the pigments is 30% by mass or less, a sufficient amount of the binder resin can be contained in the toner base particles, so that the toner becomes flexible and the fixability of the image is sufficiently increased, and the desorption of strontium titanate is less likely to occur.

Further, it is preferable that these pigment P1-1, pigment P1-2, pigment P1-3 and pigment P2 contain, by mass or less in total based on the total mass obtained by summing them, the pigment P1-2 and the pigment P2 in an amount of 60% by mass or more and 100% or less. Further, it is preferable to contain the pigment P1-1 in an amount of 0% by mass or more and 40% by mass or less based on the total mass obtained by summing them. Further, it is preferable to contain the pigment P1-3 in an amount of 0% by mass or more and 40% by mass or less based on the total mass obtained by summing them.

Further, these pigments preferably contain a pigment P1-2 in an amount of 31% by mass or more and 69% by mass or less, more preferably 35% by mass or more and 65% by mass or less, and still more preferably 40% by mass or more and 60% by mass or less, based on the total mass of the pigment P1-2 and the pigment P2 combined. Further, based on the total mass of the pigment P1-2 and the pigment P2 combined, the pigment P2 is preferably contained in an amount of 31% by mass or more and 69% by mass or less, more preferably in an amount of 35% by mass or more and 65% by mass or less, and still more preferably in an amount of 40% by mass or more and 60% by mass or less.

Note that carbon black tends to reduce the permeability of electromagnetic waves in the near infrared region, and also tends to destabilize the charging property of the toner due to high conductivity, or to reduce the dielectric tangent (transferability) because the charge cannot be retained and leaks Therefore, it is preferable that the toner base particles are substantially free of carbon black. By substantially free is meant that the content of carbon black is less than 1% by mass based on the total mass obtained by sunning up the toner base particles and the external additive 1-1-3. Other Ingredients The toner base particles may contain other ingredients including a release agent (wax) and a charge control agent, and the like.

The release agent can enhance the releasability of the toner from the fixing member or the like.

Examples of the release agents include hydrocarbon waxes including polyethylene waxes, paraffin waxes, microcrystalline waxes, Fischer-Tropsch waxes and the like; dialkyl ketone waxes including distearyl ketone and the like; ester waxes including carnauba waxes, behenyl behenate, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, trimellitic acid tristearyl, distearyl maleate and the like; and amide waxes including ethylenediamine dibehenylamine, trimelitic acid tristearylamide and the like.

The content of the above release agent is preferably 2% by mass or more and 30% by mass or less, more preferably 5% by mass or more and 20% by mass or less, based on the total mass of the toner base particles. When the content of the above release agent is 2% by mass or more, the releasability of the toner from the fixing member is sufficiently increased. When the content of the above release agent is 30% by mass or less, a sufficient amount of the binder resin can be contained in the toner base particles, so that the fixability of the image is sufficiently increased.

The charge control agent can adjust the charging property of the toner base particles.

Examples of the charge control agent include a nigrosine dye, a metal salt of a naphthenic acid or a higher fatty acid, an alkoxylated amine, a quaternary ammonium salt compound, an azo metal complex, a salicylic acid metal salt or a metal complex thereof, and the like.

The content of the charge control agent is preferably 0.1% by mass or more and 10% by mass or less, more preferably 0.5% by mass or more and 5% by mass or less, based on the total mass of the binder resin. When an attempt is made to control the charging property of the toner by a method such as excessively adding the charge control agent, other characteristics of the toner base particles may vary greatly. In contrast, in this embodiment, by adjusting the charging property of the toner by strontium titanate, it is possible to adjust the charging property of the toner to a desired degree while satisfying other required characteristics.

1-2. External Additive

The external additive includes particles of strontium titanate. The external additive may contain other components.

1-2-1. Strontium Titanate

Strontium titanate can stabilize the charging property of the toner and improve the cleaning property of the toner. In this embodiment, the charging property and the like of the toner are adjusted by including strontium titanate in the external additive. Therefore, it is not necessary to greatly change the components and the like of the toner base particles, and it is possible to adjust the charging property and the cleaning property while maintaining the characteristics of the toner base particles.

Strontium titanate can be of any of a plurality of particle shapes, either cubic or rectangular parallelepiped, irregular, and rounded cubic, depending on the method of manufacture or composition thereof. In this embodiment, strontium titanate may have any particle shape among these. For example, strontium titanate having a cubic shape or a rectangular parallelepiped shape can remove a charged product which is thinly adhered to the surface of an image carrier by an edge of its shape, so that the charging property of the toner is easily improved. Further, strontium titanate having an irregular shape tends to easily adhere to the surface of the toner base particles, so that fusion (filming) of the toner base particles to the image carrier is suppressed and cleaning property of the toner is easily enhanced Strontium titanate having a cubic shape with a rounded corner has both of these characteristics, so that it is easy to enhance the cleaning property while improving the charging property of the toner.

The shape of the particles of strontium titanate can be confirmed by observation by scanning electron microscopy (SEM)

Strontium titanate in a cubic shape or a rectangular parallelepiped shape can be obtained by a manufacturing method not passing through a firing step (wet method). Specifically, it can be synthesized by adding a hydroxide of strontium to a titania sol dispersion obtained by adjusting the pH of a hydrous titanium oxide slurry obtained by hydrolyzing an aqueous solution of titanyl sulfate, and warming it to a reaction temperature. From the viewpoint of bringing the crystallinity and the particle diameter of the titania sol into a desired range, the above-mentioned hydrous titanium oxide slurry preferably has a pH of 0.5 or more and 1.0 or less. In addition, for the purpose of removing ions adsorbed on the titania sol particles, it is preferable to add an alkaline material such as, for example, sodium hydroxide and $Sr(OH)_2.8H_2O$ to the dispersion of the titania sol. At this time, in order not to adsorb alkali metal ions or the like on the surface of the hydrous titanium oxide, it is preferable that the slurry is not made more than pH 7. In addition, the reaction temperature is preferably 60° C. or more and 100° C. or less, and in order to obtain a desired particle size distribution, the temperature rise rate is preferably 30° C./time or less, and the reaction time is preferably 3 hours or more and 12 hours or less.

Strontium titanate of an irregular shape can be obtained by a firing method via a firing step. Specifically, strontium carbonate and titanium oxide are substantially equimolar weighed, mixed by a ball mill or the like, and then pressure molded, and calcined at 1000° C. or higher and 1500° C. or less, and then, by a method of pulverizing and classifying by mechanical grinding, strontium titanate of an irregular shape can be obtained. By appropriately changing the type of the raw material, the raw material composition, the molding pressure, the firing temperature, the pulverization and classification, the shape and the particle diameter of the obtained strontium titanate can be adjusted.

Strontium titanate in a rounded cubic shape can be obtained by the method of doping lanthanum into strontium titanate. Specifically, strontium titanate having a rounded cubic shape can be obtained by heating a slurry containing strontium oxide, lanthanum oxide and titanium oxide while stirring and mixing.

When lanthanum is doped into strontium titanate, in addition to the adjustment of the particle shape described above, it is possible to adjust the degree of spheronization according to the doping amount, or it is also possible to suppress the horny wear and scratch of the surface of the image carrier. Further, when lanthanum is doped into strontium titanate, the electric resistance tends to be further lowered, so that the charging property of the toner is more easily stabilized, and in particular, excessive charging of the toner under low-temperature and low-humidity (LL) environmental conditions can be prevented.

The lanthanum content ratio when strontium titanate contains lanthanum is preferably 3.0% by mass or more and 15.0% by mass or less. When the above lanthanum content is 3.0% by mass or more, the shape of strontium titanate becomes closer to the spherical shape, and the moisture adsorption can be further reduced. When the above lanthanum content is 15.0% by mass or less, generation of coarse particles can be prevented and charging property can be further stabilized.

Presence of lanthanum in Strontium titanate, and its content can be confirmed by X-ray fluorescence analysis (XRF). Specifically, 3 g of strontium titanate is pressurized and pelletized, and measurement is performed by qualitative analysis using a fluorescent X-ray analyzer (manufactured by Shimadzu Corporation, XRF-1700, and the like), and the presence of lanthanum can be confirmed by determining the Kα peak angle of the element measured from the 2θ table.

The strontium titanate preferably has a particle diameter of a peak top in a number particle size distribution of less than 300 nm, more preferably 10 nm or more and 200 nm or less, still more preferably 10 nm or more and 100 nm or less, and particularly preferably 30 nm or more and 80 nm or less. When the above particle diameter of strontium titanate is less than 300 nm, the contact point between strontium titanate and the toner base particles is sufficiently increased, so that the adjusting action of the charging property can be more sufficiently exhibited, and in addition, destabilization of the charging property of the toner due to the desorption of strontium titanate hardly occurs. Further, when the above particle diameter of strontium titanate is less than 100 nm, in addition to the stabilization of charging property, scratching of the image carrier due to contact of the angle of strontium titanate hardly occurs. When the above particle diameter of strontium titanate is 100 nm or more, the effect of adjusting the charging property becomes more sufficient, and the fluidity of the toner does not become too high, so that the cleaning property of the toner tends to be good.

Particle size of the peak top in the number particle size distribution of strontium titanate can be obtained by image analysis of an image captured by observation with a scanning electron microscope (SEM). Specifically, of the 100 strontium titanate particles contained in the imaged image described above, the longest diameter and the shortest diameter of each particle are measured, and the sphere equivalent diameter of each strontium titanate particle is determined from intermediate value thereof. Then, the particle size of the peak top, in the number particle size distribution of the sphere equivalent diameter of the 100 strontium titanate particles, is determined as the particle size of the peak top in the number particle size distribution of strontium titanate.

The content of strontium titanate is preferably 0.3% by mass or more and 3.0% by mass or less, more preferably 0.5% by mass or more and 2.0% by mass or less, based on the total mass of the toner base particles. When the content of the above strontium titanate is 0.3% by mass or more, the charging property is more easily stabilized and the cleaning property is more easily enhanced. When the content of strontium titanate described above is 3.0 parts by mass or less, excessive charging due to strontium titanate desorbed from the toner base particles hardly occurs.

1-2-2. Other External Additives

The external additive may include particles mainly containing an inorganic material other than strontium titanate, such as silica particles, alumina particles, zirconia particles, zinc oxide particles, chromium oxide particles, cerium oxide particles, antimony oxide particles, tungsten oxide particles, tin oxide particles, tellurium oxide particles, manganese oxide particles and boron oxide particles. Particles containing these inorganic materials as a main component may be subjected to a hydrophobic treatment by a surface treatment agent such as a silane coupling agent or a silicone oil, if necessary. These particles preferably have a particle diameter of a peak top measured by a method similar to that of strontium titanate of 20 nm or more and 500 nm, and more preferably 70 nm or more and 300 nm or less.

The external additive may contain particles mainly containing an organic material containing a homopolymer such as styrene or methyl methacrylate or a copolymer thereof. It is preferable that these particles have a particle diameter of a peak top measured by a method similar to that of strontium titanate of 10 nm or more and 1000 nm or less.

The external additive may contain a lubricant such as a metal salt of a higher fatty acid. Examples of the higher fatty acid include stearic Acid, oleic acid, palmitic acid, linoleic acid and ricinoleic acid and the like. Examples of the metal constituting the above metal salt include zinc, manganese, aluminum, iron, copper, magnesium and calcium.

The content of these external additives is preferably an amount in which the total amount of the external additive combined with strontium titanate is 0.05% by mass or more and 5.0% by mass or less based on the total mass of the toner base particles.

1-3. Method for Producing Toner Base Particles

The toner base particles can be produced in the same manner as a known toner, by an emulsion polymerization aggregation method, an emulsion aggregation method and the like.

According to the emulsion polymerization aggregation method, a dispersion of particles of a binder resin obtained by an emulsion polymerization method and a dispersion of particles of a pigment are mixed together with particles such as a releasing agent and a charge control agent to be optionally added, and these are aggregated, associated or fused until particles having a desired particle diameter are obtained, and then an external additive is added.

According to the emulsion aggregation method, a dispersion of particles of a binder resin obtained by dropping a solution obtained by dissolving a binder resin into a poor solvent can be obtained by mixing a dispersion of particles of a pigment with particles such as a releasing agent and a charge control agent to be optionally added, aggregating, associating or fusing them until particles having a desired particle diameter are obtained, and then adding an external additive.

In this embodiment, since two or more kinds of pigments are internally added to the toner particles, the amount of the pigment added tends to be large. Therefore, when preparing a dispersion of particles of a pigment, it is preferable to add a surfactant to the dispersion in order to enhance dispersion stability of the pigment.

1-4. Carrier

The carrier is mixed with the toner particles described above to constitute a two components magnetic toner. The carrier may be any known magnetic particles which may be contained in a toner.

Examples of the magnetic particles include particles including magnetic materials such as iron, steel, nickel, cobalt, ferrite, and magnetite, and alloys of these with aluminum and lead. The above carrier may be a coated carrier in which a surface of particles made of the magnetic materials is coated with a resin or the like, or may be a resin dispersion type carrier in which the above-mentioned magnetic body is dispersed in a binder resin. Examples of the resin for coating include olefin resins, styrene resins, styrene-acrylic resins, silicone resins, polyester resins, and fluororesins. Examples of the binder resins include acrylic resins, styrene-acrylic resins, polyester resins, fluororesins, and phenolic resins.

The average particle diameter of the carrier preferably is 20 μm or more and 100 μm or less, and more preferably 25 μm or more and 80 μm or less, on a volume basis. Average particle size of the carrier can be measured by a laser diffractive particle size distribution measuring device with a wet disperser made by Sympatec (SYMPATEC) Co., Ltd. (HELOS) or the like.

The content of the carrier is preferably 2% by mass or more and 10% by mass or less based on the total mass of the toner particles and the carrier.

2. Image Forming Apparatus

Another embodiment of the present invention relates to an image forming apparatus including a toner image forming unit that develops an electrostatic latent image with toner to form a toner image, a fixing device that fixes the toner image to the recording medium by transferring the toner image to a recording medium, and an image forming method using the image forming layer. In this embodiment, the fixing device fixes the above-described toner to the recording medium.

The image forming apparatus may be a 4 cycle type image forming apparatus constituted by 4 color developing devices of yellow, magenta, cyan, and black, and 1 electrophotographic photoreceptors, or may be a tandem type image forming apparatus constituted by 4 color developing devices of yellow, magenta, cyan, and black, and 4 electrophotographic photoreceptors provided for each color.

FIG. 1 is a schematic configuration diagram illustrating an example of an image forming apparatus 100 relating to the present embodiment. The image forming apparatus 100 illustrated in FIG. 1 includes an image reading unit 110, an image processing unit 30, an image forming unit 40, a paper conveying unit 50, and a fixing device 60.

The image forming unit 40 has an image forming unit 41Y, 41M, 41C and 41K for forming an image by each color toner of Y (yellow), M (magenta), C (cyan), and K (black). Since all of these units have the same configuration except for the toner to be stored, a symbol representing a color may be omitted hereinafter. The image forming unit 40 further includes an intermediate transfer unit 42 and a secondary transfer unit 43, these correspond to transfer devices.

In this embodiment, the toner described above is used as a toner of K.

The image forming unit 41 includes an exposure device 411, a developing device 412, an electrophotographic photoreceptor (image carrier) 413, a charging device 414, and a drum cleaning device 415. The charging device 414 is, for example, a corona charger. The charging device 414 may be a contact charging device in which a contact charging member such as a charging roller, a charging brush, or a charging blade is brought into contact with the electrophotographic photoreceptor 413 so as to be charged. The exposure apparatus 411 includes, for example, a semiconductor laser as a light source and an optical deflection apparatus (polygon motor) that irradiates a laser beam corresponding to an image to be formed toward the electrophotographic photoreceptor 413. The electrophotographic photoreceptor 413 is a negatively charged organic photoreceptor having photoconductivity. The electrophotographic photoreceptor 413 is charged by a charging device 414.

The developing apparatus 412 is a developing device of a two components development system. The developing device 412 includes, for example, a developing container containing a two components developer, a developing roller (magnetic roller) rotatably disposed at an opening of the developing container, a partition wall for defining the wall of the developing container while the two components developer can move inside the developing container, a conveying roller for conveying the two components developer on the side of the opening in the developing container toward the developing roller, and a stirring roller for stirring the two components developer in the developing container. In the developing container, for example, a two components developer is contained.

The intermediate transfer unit 42 includes an intermediate transfer belt (intermediate transfer body) 421, a primary transfer roller 422 that presses the intermediate transfer belt 421 against the electrophotographic photoreceptor 413, a plurality of support rollers 423 including a backup roller 423A, and a belt cleaning device 426. The intermediate transfer belt 421 is looped over a plurality of support rollers 423. As at least one driving roller of the plurality of support rollers 423 rotates, the intermediate transfer belt 421 travels at a constant speed in the direction of the arrow A.

The belt cleaning device 426 has an elastic member 426*a*. The elastic member 426*a* abuts on the intermediate transfer belt 421 after the secondary transfer to remove the adhered matter on the surface of the intermediate transfer belt 421 The elastic member 426*a* is formed of an elastic body, and includes a cleaning blade, a brush, and the like.

The secondary transfer unit 43 has an endless secondary transfer belt 432, and a plurality of support rollers 431 including a secondary transfer roller 431A. The secondary transfer belt 432 is looped by a secondary transfer roller 431A and a support roller 431.

The fixing device 60 includes, for example, a fixing roller 62, an endless heat generating belt 10 that covers the outer peripheral surface of the fixing roller 62 and heats and melts the toner constituting the toner image on the sheet S, and a pressing roller 63 that presses the sheet S toward the fixing roller 62 and the heat generating belt 10. The sheet S corresponds to a recording medium.

The image forming apparatus 100 further includes an image reading unit 110, an image processing unit 30, and a sheet conveying unit 50. The image reading unit 110 includes a paper feeding device 111 and a scanner 112. The paper conveying unit 50 includes a paper feeding unit 51, a paper discharge unit 52, and a conveyance path unit 53. The three paper feed tray units Sla to Sic constituting the paper feed unit 51 store the sheet S (any of standard paper and special paper) identified based on the basis weight, the size, and the like for each set type in advance. The transport path unit 53 has a plurality of transport roller pairs such as a resist roller pair 53*a*.

Formation of an image by the image forming apparatus 100 will be described.

The scanner 112 optically scans and reads the document D on the contact glass. Reflected light from the document D is read by the CCD sensor 112*a* and becomes input image data. The input image data is subjected to predetermined image processing in the image processing unit 30 and is sent to the exposure apparatus 411.

The electrophotographic photoreceptor 413 rotates at a constant circumferential speed. The charging device 414 uniformly charges the surface of the electrophotographic photoreceptor 413 to a negative polarity. In the exposure apparatus 411, the polygon mirror of the polygon motor rotates at a high speed, and the laser beam corresponding to the input image data of each color component is developed along the axial direction of the electrophotographic photoreceptor 413 and is irradiated to the outer peripheral surface of the electrophotographic photoreceptor 413 along the axial direction. Thus, an electrostatic latent image is formed on the surface of the electrophotographic photoreceptor 413.

In the developing device 412, toner particles are charged by stirring and conveying of the two components developer in the developing container, and the two components developer is conveyed to the developing roller to form a magnetic brush on the surface of the developing roller. The charged toner particles electrostatically adhere from the magnetic brush to the portion of the electrostatic latent image in the electrophotographic photoreceptor 413. In this way, the electrostatic latent image of the surface of the electrophotographic photoreceptor 413 is visualized, and a toner image corresponding to the electrostatic latent image is formed on the surface of the electrophotographic photoreceptor 413. The "toner image" refers to a state in which the toner is assembled in an image form.

The toner image on the surface of the electrophotographic photoreceptor 413 is transferred to the intermediate transfer belt 421 by the intermediate transfer unit 42. The transfer residual toner remaining on the surface of the electrophotographic photoreceptor 413 after transfer is removed by a drum cleaning device 415 having a drum cleaning blade which is slidably brought into contact with the surface of the electrophotographic photoreceptor 413.

By pressing the intermediate transfer belt 421 against the electrophotographic photoreceptor 413 by the primary transfer roller 422, a primary transfer nip is formed for each electrophotographic photoreceptor by the electrophotographic photoreceptor 413 and the intermediate transfer belt 421. In the primary transfer nip, toner images of each color are sequentially overlapped and transferred onto the intermediate transfer belt 421.

On the other hand, the secondary transfer roller 431A is pressed against the back-up roller 423A via the intermediate transfer belt 421 and the secondary transfer belt 432. Thereby, a secondary transfer nip is formed by the intermediate transfer belt 421 and the secondary transfer belt 432. Sheet S passes through the secondary transfer nip. The sheet S is conveyed to the secondary transfer nip by the sheet conveying unit 50. The correction of the inclination of the sheet S and the adjustment of the timing of the conveyance are performed by the resist roller portion in which the resist roller pair 53*a* is disposed.

When the sheet S is conveyed to the secondary transfer nip, a transfer bias is applied to the secondary transfer roller 431A. By applying this transfer bias, a toner image carried on the intermediate transfer belt 421 is transferred onto the sheet S (a step of adhering the toner for developing an electrostatic charge image to the recording medium). The sheet S to which the toner image has been transferred is conveyed toward the fixing device 60 by the secondary transfer belt 432.

Attachments such as transfer residual toner remaining on the surface of the intermediate transfer belt 421 after the secondary transfer are removed by the belt cleaning device 426 having a cleaning blade which is slidably brought into contact with the surface of the intermediate transfer belt 421. At this time, since the aforementioned intermediate transfer member is used as the intermediate transfer belt, the dynamic friction force can be reduced over time.

The fixing device 60 forms a fixing nip by the heat generating belt 10 and the pressure roller 63, and heats and pressurizes the conveyed sheet S at the fixing nip section. Thus, the toner image is fixed to the sheet S (a step of fixing the toner for electrostatic charge image development to the recording medium). The sheet S on which the toner image is fixed is discharged outside the machine by a sheet discharge unit 52 provided with a sheet discharge roller 52*a*.

Note that the apparatus configuration and the image forming method described above are exemplary forms for carrying out the present invention, and the present invention is not limited thereto.

For example, a monochromatic image using only the above-mentioned toners may be formed, or an image using only the above-mentioned toners toner and the toner that absorbs electromagnetic waves in the near-infrared region may be formed, by an apparatus corresponding thereto.

EXAMPLES

Hereinafter, the present invention will be described in more detail with reference to Examples, but the present invention is not limited thereto.

Note that, in the following examples, when there is no particular reference, the average particle diameter of each particle is a value measured using Microtrack Co., Ltd., Microtrack UPA-150 ("MICROTRAC, registered trademark of the company).

1. Preparation of the Toner 1-1. Preparation of Pigment Particle Dispersions 1-1-1. Preparation of Pigment Particle Dispersion (I)

Pigment Brown 25 (PBr25): 40 parts by mass
Pigment Blue 15:3 (PB15:3): 25 parts by mass
Pigment Violet 23 (PV23): 10 parts by mass
Pigment Yellow 155 (PY155): 25 parts by mass
Anionic surfactant: 15 parts by mass
Ion exchange water: 400 parts by mass The above components were mixed and pre-dispersed by a homogenizer (manufactured by IKA Co., Ltd., Ultratalax) for 10 minutes, and then subjected to a dispersion treatment using a high pressure impact type disperser (manufactured by Sugino Machine Co., Ltd., Altimizer) for 30 minutes 245 MPa pressure to obtain an aqueous dispersion of particles containing these pigments. A pigment particle dispersion (1) was prepared by adding ion-exchanged water to the obtained dispersion to adjust the solid content to 15% by mass. The average particle diameter on a volume basis of the pigment particles in the pigment particle dispersion (I) was 150 nm.

The above anionic surfactant is Neogen RK manufactured by Dai-ichi Kogyo Seiyaku Co., Ltd ("Neogen" is a registered trademark of the company).

1-1-2. Preparation of Pigment Particle Dispersion (2)

A pigment particle dispersion (2) was prepared in the same manner as in the preparation of the pigment particle dispersion (1), except that Pigment Brown 23 (PBr23) was used instead of Pigment Brown 25. The average particle diameter on a volume basis of the pigment particles in the pigment particle dispersion (2) was 150 nm.

1-1-3. Preparation of Pigment Particle Dispersion (3)

A pigment particle dispersion (3) was prepared in the same manner as in the preparation of the pigment particle dispersion (1), except that Pigment Yellow 180 (PY180) was used instead of Pigment Yellow 155. The average particle diameter on a volume basis of the pigment particles in the pigment particle dispersion (3) was 150 nm.

1-1-4. Preparation of Pigment Particle Dispersion (4)

A pigment particle dispersion (4) was prepared in the same manner as in the preparation of the pigment particle dispersion (1), except that the blending ratio of each organic pigment was changed as follows. The average particle diameter on a volume basis of the pigment particles in the pigment particle dispersion (4) was 150 nm.

Pigment Brown 25 (PBr25): 60 parts by mass
Pigment Blue 15:3 (PB15:3): 40 parts by mass
Pigment Violet 23 (PV23): 0 parts by mass
Pigment Yellow 155 (PY155): 0 parts by mass 1-1-5. Preparation of Pigment Particle Dispersion (5)

A pigment particle dispersion (5) was prepared in the same manner as in the preparation of the pigment particle dispersion (1), except that the blending ratio of each organic pigment was changed as follows. The average particle diameter on a volume basis of the pigment particles in the pigment particle dispersion (5) was 150 nm.

Pigment Brown 25 (PBr25): 55 parts by mass
Pigment Blue 15:3 (PB15:3): 35 parts by mass
Pigment Violet 23 (PV23): 10 parts by mass
Pigment Yellow 155 (PY155): 0 parts by mass 1-1-6. Preparation of Pigment Particle Dispersion (6)

A pigment particle dispersion (6) was prepared in the same manner as in the preparation of the pigment particle dispersion (1), except that the blending ratio of each organic pigment was changed as follows. The average particle diameter on a volume basis of the pigment particles in the pigment particle dispersion (6) was 150 nm.

Pigment Brown 25 (PBr25): 45 parts by mass
Pigment Blue 15:3 (PB15:3) 30 parts by mass
Pigment Violet 23 (PV23): 0 parts by mass
Pigment Yellow 155 (PY155): 25 parts by mass 1-1-7. Preparation of Pigment Particle Dispersion (7)

A pigment particle dispersion (7) was prepared in the same manner as in the preparation of the pigment particle dispersion (1), except that 100 parts by mass of carbon black (CB) (manufactured by Cabot Co., Ltd., Legal 330 ("Legal" is a registered trademark of the company)) was added instead of each organic pigment. The average particle diameter on a volume basis of the pigment particles in the pigment particle dispersion (7) was 150 nm.

1-1-8. Preparation of Pigment Particle Dispersion (8)

A pigment particle dispersion (8) was prepared in the same manner as in the preparation of the pigment particle dispersion (1), except that the blending ratio of each organic pigment was changed as follows. The average particle diameter on a volume basis of the pigment particles in the pigment particle dispersion (8) was 150 nm.

Pigment Brown 25 (PBr25): 0 parts by mass
Pigment Blue 15:3 (PB15:3): 65 parts by mass
Pigment Violet 23 (PV23): 10 parts by mass
Pigment Yellow 155 (PY155): 25 parts by mass 1-1-9. Preparation of Pigment Particle Dispersion (9)

A pigment particle dispersion (9) was prepared in the same manner as in the preparation of the pigment particle dispersion (1), except that the blending ratio of each organic pigment was changed as follows. The average particle diameter on a volume basis of the pigment particles in the pigment particle dispersion (9) was 150 nm.

Pigment Brown 25 (PBr25): 65 parts by mass
Pigment Blue 15:3 (PB15:3): 0 parts by mass
Pigment Violet 23 (PV23): 10 parts by mass
Pigment Yellow 155 (PY155): 25 parts by mass 1-1-10. Preparation of Pigment Particle Dispersion (10)

A pigment particle dispersion (10) was prepared in the same manner as in the preparation of the pigment particle dispersion (1), except that the blending ratio of each organic pigment was charged as follows. The average particle diameter on a volume basis of the pigment particles in the pigment particle dispersion (10) was 150 nm.

Pigment Violet 23 (PV23): 28 parts by mass

Pigment Yellow 155 (PY155): 72 parts by mass

The absorption maximum wavelength Δ max (nm) of each pigment used in preparing the pigment particle dispersion when dispersed in methyl ethyl ketone is as shown in Table 1

TABLE 1

| Type of Pigment | Name of Pigment | λ max |
|---|---|---|
| P1-2 | PBr23 | 490 nm |
| P1-2 | PBr25 | 490 nm |
| P2 | PB15:3 | 630 nm |
| P1-3 | PV23 | 570 nm |
| P1-1 | PY155 | 405 nm |
| P1-1 | PY180 | 420 nm |

1-2. Preparation of Amorphous Resin Particle Dispersions 1-2-1. Preparation of Amorphous Polyester Resin Particle Dispersion (a1)

Bisphenol A ethylene oxide 2.2 molar adduct: 40 parts by mole

Bisphenol A propylene oxide 2.2 molar adduct: 60 parts by mole

Dimethyl terephthalate: 60 parts by mole

Dimethyl fumarate: 15 parts by mole

Dodecenyl succinic anhydride: 20 parts by mole

Trimellitic anhydride: 5 parts by mole

A monomer other than dimethyl fumarate and trimellitic anhydride among the above monomers and tin dioctylate in an amount of 0.25 parts by mass per 100 parts by mass of the total of the above monomers were charged into a reaction vessel equipped with a stirrer, a thermometer, a capacitor and a nitrogen gas introduction pipe. Under a stream of nitrogen gas, the mixture was allowed to react for 6 hours at 235° C., and then cooled to 200° C. and the above amount of dimethyl fumarate and trimellitic anhydride were added and reacted for 1 hours. The temperature was increased over 5 hours to 220° C., and the mixture was polymerized to a desired molecular weight under a pressure of 10 kPa to obtain a pale yellow transparent amorphous polyester resin (A1).

The amorphous polyester resin (A1) had a weight average molecular weight of 35,000, a number average molecular weight of 8000, and a glass transition temperature (Tg) of 56° C.

Then, 200 parts by mass of an amorphous polyester resin (A1), 100 parts by mass of methyl ethyl ketone, 35 parts by mass of isopropyl alcohol, and 7.0 parts by mass of a 10% by mass aqueous ammonia solution were placed in a separable flask, mixed and dissolved thoroughly, and then, while heating and stirring at 40° C., ion-exchanged water was dropped using a liquid feed pump at a liquid feed rate of 8 g/min, and dropping was stopped when the liquid feed amount became 580 parts by mass. Thereafter, solvent removal was performed under reduced pressure to obtain an amorphous polyester resin particle dispersion. Ion-exchanged water was added to the above dispersion to adjust the solid content to 25% by mass to prepare an amorphous polyester resin particle dispersion (a1). The average particle diameter on a volume basis of the amorphous polyester resin (A1) in the amorphous polyester resin particle dispersion (a1) was 156 nm.

1-2-2. Preparation of Styrene-Acrylic Resin Particle Dispersion (b1)

Styrene: 903.0 parts by mass

N-butyl acrylate: 282.0 parts by mass

Acrylic acid: 12.0 parts by mass 1,10-decanediol diacrylate: 3.0 parts by mass

Dodecanethiol: 8.1 parts by mass

A 5 L reaction vessel fitted with a stirring device, a temperature sensor, a cooling pipe and a nitrogen introducing device was charged with 5.0 parts by mass of an anionic surfactant (Dow Chemical Co., Ltd., Dowfax 2A1, "Dowfax" is a registered trademark of the company) and 2500 parts by mass of ion-exchanged water, and the internal temperature was raised to 75° C. while stirring at a stirring speed of 230 rpm under a nitrogen stream.

Then, a solution obtained by dissolving 18.0 parts by mass of potassium persulfate (KPS) in 342 parts by mass of ion-exchanged water was added, and the liquid temperature was set at 75° C. Further, a mixture of the above monomers was added dropwise over a period of 2 hours. After completion of the dropwise addition, the mixture was polymerized by heating and stirring at 75° C. for 2 hours to obtain an amorphous vinyl resin dispersion. Ion-exchanged water was added to the dispersion to adjust the solid content to 25 mass %, thereby prepared a dispersion (b1) of amorphous vinyl resin (B1) particles. The average particle diameter on a volume basis of the amorphous vinyl resin (B1) was 160 nm.

The amorphous vinyl resin (B1) had a weight average molecular weight (Mw) of 38,000, a number average molecular weight (Mn) of 15,000, and a glass transition temperature (Tg) of 52° C.

1-3. Preparation of Crystalline Resin Particle Dispersions 1-3-1. Preparation of Crystalline Polyester Resin Particle Dispersion (c1)

Dodecanediacid: 50 parts by mole 1,6-hexanediol: 50 parts by mole

The above monomer was put into a reaction vessel equipped with a stirrer, a thermometer, a capacitor and a nitrogen gas introduction pipe, and the inside of the reaction vessel was replaced with dry nitrogen gas. Then, titanium tetrabutoxide ($Ti(O\text{-}n\text{-}Bu)_4$) in an amount of 0.25 parts by mass based on 100 parts by mass of the above monomer was charged After stirring and reacting under a stream of nitrogen gas for 3 hours at 170° C., the temperature was further increased over a period of 1 hours to 210° C., the inside of the reaction vessel was reduced in pressure to 3 kPa, and stirred under reduced pressure for 13 hours to react, thereby obtaining a crystalline polyester resin (C1). The crystalline polyester resin (C1) had a weight average molecular weight of 25,000, a number average molecular weight of 8500, and a melting point of 71.8° C.

Next, 200 parts by mass of the crystalline polyester resin (C1), 120 parts by mass of methyl ethyl ketone, and 30 parts by mass of isopropyl alcohol were placed in a separable flask, sufficiently mixed and dissolved at 60° C., and then 8 parts by mass of an aqueous 10% by mass ammonia solution was added dropwise. The heating temperature was lowered to 67° C., and dropping was performed using an ion exchange water feed pump while stirring at a liquid feed rate of 8 g/min, and when the liquid feed amount became 580 parts by mass, dropping of ion exchange water was stopped. Thereafter, solvent removal was performed under reduced pressure to obtain a crystalline polyester resin particle dispersion. Ion-exchanged water was added to the above dispersion to adjust the solid content to 25% by mass to prepare a crystalline polyester resin particle dispersion (c1). The average particle diameter on a volume basis of the crystalline polyester resin (C1) in the crystalline polyester resin particle dispersion (c1) was 198 nm.

1-4. Preparation of Mold Release Agent Particle Dispersion (W1)

Paraffin wax: 270 parts by mass

Anionic surfactant: 13.5 parts by mass (60% active ingredient, 3% based on paraffin wax)

Ion exchange water: 21.6 parts by mass

The above materials were mixed, and the release agent was dissolved in a pressure discharge type homogenizer (Gorin Co., Ltd., Gorin homogenizer) at an internal liquid temperature of 120° C., followed by a dispersion treatment with a dispersion pressure of 5 MPa for 120 minutes, followed by a dispersion treatment with 40 MPa for 360 minutes, and then cooled to obtain a dispersion. Ion-exchanged water was added to adjust the solid content to 20% to prepare a release agent dispersion (W1). The average particle diameter on a volume basis of particles in the release agent dispersion (W1) was 215 nm.

The above paraffin wax is HNP0190 (melting temperature: 85° C.) manufactured by Nippon Seiwax Co., Ltd., and the above anionic surfactant is Neogen RK manufactured by Dai-ichi Kogyo Seiyaku Co., Ltd.

1-5. Preparation of Toner Base Particles 1-5-1. Preparation of Toner Base Particles (1)

Amorphous polyester resin particle dispersion (a1): 1280 parts by mass

Crystalline polyester resin particle dispersion (c1): 160 parts by mass

Release agent particle dispersion (W1) 200 parts by mass

Pigment particle dispersion (1): 335 parts by mass

Anionic surfactant: 40 parts by mass

Ion exchange water: 1500 parts by mass

A 4 liter reaction vessel equipped with a thermometer, a pH meter and a stirrer was charged with the above material, and a 1.0% by mass aqueous nitric acid solution was added under a temperature of 25° C. to adjust the pH to 3.0. Thereafter, 100 parts by mass of an aqueous solution of 2.0% by mass aluminum sulfate (flocculant) was added over 30 minutes while being dispersed at 3,000 rpm in a homogenizer (manufactured by IKA Corporation. Ultratalax T50). After completion of the dropping, the mixture was stirred for 10 minutes, and the raw material and the flocculant were thoroughly mixed.

Thereafter, a stirrer and a mantle heater are installed in the reaction vessel, while adjusting the number of revolutions of the stirrer so that the slurry is sufficiently stirred, the slurry was heated at a temperature rise rate of 0.2° C./min up to a temperature of 40° C., and a temperature rise rate of 0.05° C./min after exceeding 40° C., and particle size was measured every 10 minutes by a particle size distribution measuring device (manufactured by Beckman Coulter Co., Ltd., Coulter Multisizer 3 (aperture diameter 100 μm)). The temperature was held at a point where the average particle diameter on a volume basis became 5.9 μm, and a mixed liquid of the following materials prepared in advance was charged over a period of 20 minutes.

Amorphous polyester resin particle dispersion (a1): 160 parts by mass

Anionic surfactant: 15 parts by mass

Both of the anionic surfactants charged 2 times described above are Dowfax 2A1 (20% aqueous solution) manufactured by Dow Chemical Co., Ltd.

Then after holding at 50° C. for 30 minutes, 8 parts by mass of an aqueous solution of 20% by mass of EDTA (ethylenediaminetetraacetic acid) was added to the reaction vessel, and then mol/L of an aqueous solution of sodium hydroxide was added to control the pH of the raw material dispersion to 9.0. Thereafter, while adjusting the pH to 9.0 every 5° C., the temperature was raised to 85° C. at a heating rate of 1° C./min, and held at 85° C.

Thereafter, the mixture was cooled at a temperature lowering rate of 10° C./min at a time point when the shape factor measured using a particle size meter (manufactured by Mulban Co., Ltd., FPIA-3000) became 0.970, thereby obtained a toner base particle dispersion (1).

Thereafter, the solid content obtained by filtering the toner base particle dispersion (1) was sufficiently washed with ion-exchanged water. Then, the solid content was dried at 40° C. to obtain toner base particles (1). The average particle diameter on a volume basis of the obtained toner base particles (1) was 6.0 μm, and the average circularity measured using a particle size meter (manufactured by Malvern Co., Ltd., FPIA-3000) was 0.972.

1-5-2. Preparation of Toner Base Particles (2)

Amorphous polyester resin particle dispersion (a1): 1440 parts by mass

Release agent particle dispersion (W1): 200 parts by mass

Pigment particle dispersion (1): 335 parts by mass

Anionic surfactant: 40 parts by mass

Ion exchange water: 1500 parts by mass

A 4 liter reaction vessel equipped with a thermometer, a pH meter and a stirrer was charged with the above material, and a 1.0% by mass aqueous nitric acid solution was added under a temperature of 25° C. to adjust the pH to 3.0. Thereafter, 100 parts by mass of an aqueous solution of 2.0% by mass aluminum sulfate (flocculant) was added over 30 minutes while being dispersed at 3000 rpm in a homogenizer (manufactured by IKA Corporation. Ultratalax T50). After completion of the dropping, the mixture was stirred for 10 minutes, and the raw material and the flocculant were thoroughly mixed.

Thereafter, a stirrer and a mantle heater are installed in the reaction vessel, while adjusting the number of revolutions of the stirrer so that the slurry is sufficiently stirred, the slurry was heated at a temperature rise rate of 0.2° C./min up to a temperature of 40° C., and a temperature rise rate of 0.05° C./min after exceeding 40° C., and particle size was measured every 10 minutes by a particle size distribution measuring device (manufactured by Beckman Coulter Co. Ltd., Coulter Multisizer 3 (aperture diameter 100 μm)). The temperature was held at a point where the average particle diameter on a volume basis became 5.9 μm, and a mixed liquid of the following materials prepared in advance was charged over a period of 20 minutes.

Amorphous polyester resin particle dispersion (a1): 160 parts by mass

Anionic surfactant: 15 parts by mass

Both of the anionic surfactants charged 2 times described above are Dowfax 2A1 (20% aqueous solution) manufactured by Dow Chemical Co., Ltd.

Then, after holding at 50° C. for 30 minutes, 8 parts of a 20% solution of EDTA (ethylenediaminetetraacetic acid) was added to the reaction vessel, and then 1 mol/L of an aqueous sodium hydroxide solution was added thereto to control the pH of the raw material dispersion to 9.0. Thereafter, while adjusting the pH to 9.0 every 5° C., the temperature was raised to 85° C. at a heating rate 1° C./min, and held at 85° C.

Thereafter, the mixture was cooled at a temperature lowering rate of 10° C./min at a time point when the shape factor measured using a particle size meter (manufactured by Mulban Co., Ltd., FPIA-3000) became 0.970, thereby obtained a toner base particle dispersion (2).

Thereafter, the solid content obtained by filtering the toner base particle dispersion (2) was sufficiently washed with ion-exchanged water. Then, the solid content was dried at 40° C. to obtain toner base particles (2). The average particle diameter on a volume basis of the obtained toner base particles (2) was 6.0 μm, and the average circularity measured using a particle size meter (manufactured by Malvern Co., Ltd., FPIA-3000) was 0.972.

1-5-3. Preparation of Toner Base Particles (3)

Toner base particles (3) were obtained in the same manner as in the preparation of toner base particles (1), except that pigment particle dispersion (2) was used instead of pigment particle dispersion (1). The average particle diameter on a volume basis of the obtained toner base particles (3) was 6.0 μm, and the average circularity measured using a particle size distribution measuring device (manufactured by Malvern Co., Ltd., FPIA-3000) was 0.972.

1-5-4. Preparation of Toner Base Particles (4)

Toner base particles (4) were obtained in the same manner as in the preparation of toner base particles (1), except that pigment particle dispersion (3) was used instead of pigment particle dispersion (1). The average particle diameter on a volume basis of the obtained toner base particles (4) was 6.0 μm, and the average circularity measured using a particle size meter (manufactured by Malvern Co., Ltd., FPIA-3000) was 0.972.

1-5-5. Preparation of Toner Base Particles (5)

Styrene-acrylic resin particle dispersion (b1): 1280 parts by mass

Crystalline polyester resin particle dispersion (c1): 160 parts by mass

Release agent particle dispersion (W1): 200 parts by mass

Pigment particle dispersion (1): 335 parts by mass

Anionic surfactant: 40 parts by mass

Ion exchange water: 1500 parts by mass

A 4 liter reaction vessel equipped with a thermometer, a pH meter and a stirrer was charged with the above material, and a 1.0% by mass aqueous nitric acid solution was added under a temperature of 25° C. to adjust the pH to 3.0. Thereafter, 100 parts by mass of an aqueous solution of 2.0% by mass aluminum sulfate (flocculant) was added over 30 minutes while being dispersed at 3,000 rpm in a homogenizer (manufactured by IKA Corporation, Ultratalax T50). After completion of the dropping, the mixture was stirred for 10 minutes, and the raw material and the flocculant were thoroughly mixed.

Thereafter, a stirrer and a mantle heater are installed in the reaction vessel, while adjusting the number of revolutions of the stirrer so that the slurry is sufficiently stirred, a temperature rise rate of 0.2° C./min up to a temperature of 40° C., and a temperature the slurry was heated at a temperature rise rate of 0.2° C./min up to a temperature of 40° C. and a temperature rise rate of 0.05° C./min after exceeding 40° C., and particle size was measured every 10 minutes by a particle size distribution measuring device (manufactured by Beckman Coulter Co. Ltd., Coulter Multisizer 3 (aperture diameter 100 μm)). The temperature was held at a point where the average particle diameter on a volume basis became 5.9 μm, and a mixed liquid of the following materials prepared in advance was charged over a period of 20 minutes.

Amorphous polyester resin particle dispersion (a1): 160 parts by mass

Anionic surfactant: 15 parts by mass

Both of the anionic surfactants charged 2 times described above are Dowfax 2A1 (20% aqueous solution) manufactured by Dow Chemical Co., Ltd.

Then, after holding at 50° C. for 30 minutes, 8 parts by mass of an aqueous solution of 20% by mass of EDTA (ethylenediaminetetraacetic acid) was added to the reaction vessel, and then 1 mol/L of an aqueous solution of sodium hydroxide was added to control the pH of the raw material dispersion to 9.0. Thereafter, while adjusting the pH to 9.0 every 5° C., the temperature was raised to 85° C. at a heating rate 1° C./min, and held at 85° C.

Thereafter, the mixture was cooled at a temperature lowering rate of 10° C./min at a time point when the shape factor measured using a particle size meter (manufactured by Mulban Co., Ltd., FPIA-3000) became 0.970, thereby obtained a toner base particle dispersion (5).

Thereafter, the solid content obtained by filtering the toner base particle dispersion (5) was sufficiently washed with ion-exchanged water. Then, the solid content was dried at 40° C. to obtain toner base particles (5). The average particle diameter on a volume basis of the obtained toner base particles (5) was 60 μm, and the average circularity measured using a particle size meter (manufactured by Malvern Co., Ltd., FPIA-3000) was 0.972.

1-5-6. Preparation of Toner Base Particles (6)

Toner base particles (6) were obtained in the same manner as in the preparation of the toner base particle dispersion (1), except that the pigment particle dispersion (4) was used instead of the pigment particle dispersion (1). The average particle diameter on a volume basis of the obtained toner base particles (6) was 6.0 μm, and the average circularity measured using a particle size meter (manufactured by Malvern Co., Ltd., FPIA-3000) was 0.972.

1-5-7. Preparation of Toner Base Particles (7)

Toner base particles (7) were obtained in the same manner as in the preparation of the toner base particle dispersion (1), except that the pigment particle dispersion (5) was used instead of the pigment particle dispersion (1). The average particle diameter on a volume basis of the obtained toner base particles (7) was 6.0 μm, and the average circularity measured using a particle size meter (manufactured by Malvern Co., Ltd., FPIA-3000) was 0.972.

1-5-8. Preparation of Toner Base Particles (8)

Toner base particles (8) were obtained in the same manner as in the preparation of the toner base particle dispersion (1), except that the pigment particle dispersion (6) was used instead of the pigment particle dispersion (1). The average particle diameter of the obtained toner base particles (8) on a volume basis was 6.0 μm, and the average circularity measured using a particle size meter (manufactured by Malvern Co., Ltd., FPIA-3000) was 0.972.

1-5-9. Preparation of Toner Base Particles (9)

Toner base particles (9) were obtained in the same manner as in the preparation of the toner base particle dispersion (1), except that the pigment particle dispersion (7) was used instead of the pigment particle dispersion (1). The average particle diameter on a volume basis of the obtained toner base particles (9) was 6.0 μm, and the average circularity measured using a particle size meter (manufactured by Malvern Co., Ltd., FPIA-3000) was 0.972.

1-5-10. Preparation of Toner Base Particles (10)

Toner base particles (10) were obtained in the same manner as in the preparation of the toner base particle dispersion (t), except that the pigment particle dispersion (8) was used instead of the pigment particle dispersion (1). The average particle diameter on a volume basis of the obtained toner base particles (10) was 6.0 μm, and the average circularity measured using a particle size meter (manufactured by Malvern Co., Ltd., FPIA-3000) was 0.972.

1-5-11. Preparation of Toner Base Particles (11)

Toner base particles (11) were obtained in the same manner as in the preparation of the toner base particle dispersion (1), except that the pigment particle dispersion (9) was used instead of the pigment particle dispersion (1). The average particle diameter of the obtained toner base particles (11) on a volume basis was 6.0 μm, and the average circularity measured using a particle size meter (manufactured by Malvern Co., Ltd., FPIA-3000) was 0.972.

1-5-12. Preparation of Toner Base Particles (12)

Toner base particles (12) were obtained in the same manner as in the preparation of the toner base particle dispersion (1), except that the pigment particle dispersion (10) was used instead of the pigment particle dispersion (1). The average particle diameter on a volume basis of the obtained toner base particles (12) was 6.0 μm, and the average circularity measured using a particle size meter (manufactured by Malvern Co., Ltd., FPIA-3000) was 0.972.

1-6. Preparation of Strontium Titanate

For the following strontium titanate, the particle size of the peak top was obtained by image analysis of an image captured by observation with a scanning electron microscope (SEM). Specifically, of the 100 strontium titanate particles contained in the imaged image described above, the longest diameter and the shortest diameter of each particle are measured, and the sphere equivalent diameter of each strontium titanate particle is determined from intermediate value thereof. Then, the particle size of the peak top, in the number particle size distribution of the sphere equivalent diameter of the 100 strontium titanate particles, is determined as the particle size of the peak top in the number particle size distribution of the strontium titanate.

1-6-1. Preparation of Strontium Titanate (1)

After the metatitanic acid obtained by the sulfuric acid method was subjected to a deiron bleaching treatment, an aqueous sodium hydroxide solution was added to adjust the pH to 9.0, and a desulfurization treatment was performed, followed by neutralization to pH 5.8 by hydrochloric acid, and filtered water washing was performed. Water was added to the washed cake to obtain a slurry having a $TiO_2$ content of 1.85 mol/L, and then hydrochloric acid was added to adjust the pH to 1.0, and a peptizing treatment was performed. This metatitanic acid was collected by an amount in which the amount of $TiO_2$ became 0.625 mol and charged into a 3 L reactor vessel. Further, strontium chloride aqueous solution and lanthanum chloride aqueous solution was added in a total of 0.663 mol so that Sr/La Ti molar ratio became 1.00/0.06/1.00, and then water was added so that $TiO_2$ concentration became 0.313 mol/L. Next, after warming to 90° C. with stirring and mixing, 296 mL of SN aqueous sodium hydroxide solution was added over 11 hours, and then stirring was continued at 95° C. for 2 hours to terminate the reaction.

The reaction slurry thus obtained was cooled to 50° C. hydrochloric acid was added until pH became 5.0, and stirring was further continued for 1 hours. The obtained precipitate was decanted and washed, hydrochloric acid was added to the slurry containing the precipitate to adjust the pH to 6.5, and 9% by weight of isobutyltrimethoxysilane was added to the solid content, and then continued stirring and holding for 1 hours. Then, filtration and washing were performed, and the obtained cake was dried in air at 120° C. for 8 hours to obtain lanthanum-doped strontium titanate (1). SEM observation confirmed that Strontium titanate (1) have a rounded cubic particle shape. The number average particle diameter of lanthanum-doped strontium titanate (1) was 60 nm.

1-6-2. Preparation of Strontium Titanate (2)

After wet mixing 1500 g of strontium carbonate and 800 g of titanium oxide, in a ball mill, for 8 hours, and filtered and dried, the mixture was molded at a pressure of 5 kg/cm$^2$ and calcined for 8 hours at 1300° C. The mold was mechanically ground and classified to obtain strontium titanate (2). SEM observation confirmed that Strontium titanate (2) have an irregular particle shape. The number average particle diameter of strontium titanate (2) was 60 nm.

1-6-3. Preparation of Strontium Titanate (3)

A hydrous Titanium Oxide slurry obtained by hydrolyzing an aqueous solution of titanyl sulfate was washed with an aqueous alkali solution. Hydrochloric acid was then added to the slurry of the hydrous titanium oxide to adjust the pH to 0.65 to obtain a titania sol dispersion. NaOH was added to this titania sol dispersion to adjust the pH of the dispersion to 4.7, and the washing was repeated until the electric conductivity of the supernatant liquid became 50 μS/cm. To this hydrous Titanium Oxide dispersion, 0.97 times molar amounts of $Sr(OH)_2.8H_2O$ were added and placed in a reaction vessel made of SUS, and nitrogen gas was replaced. Further, distilled water was added so that the amount of $SrTiO_3$ was 0.6 mol/liter. The slurry in a nitrogen atmosphere was heated at 10° C./hour to 65° C. 8 hours reaction was carried out after reaching 65° C. After the reaction the slurry was cooled to room temperature and the supernatant liquid was removed, washing was repeated with pure water, and then filtration was performed with a Nutche, and the obtained cake was dried to obtain strontium titanate (3). SEM observation confirmed that Strontium titanate (3) have a cubic or rectangular parallelepiped particle shape. The number average particle diameter of strontium titanate (3) was 60 nm.

1-6-4. Preparation of Strontium Titanate (4)

A hydrous Titanium Oxide slurry obtained by hydrolyzing an aqueous solution of titanyl sulfate was washed with an aqueous alkali solution. Hydrochloric acid was then added to the slurry of the hydrous titanium oxide to adjust the pH to 0.65 to obtain a titania sol dispersion. NaOH was added to this titania sol dispersion to a just the pH of the dispersion to 4.7, and the washing was repeated until the electric conductivity of the supernatant liquid became 50 μS/cm. To this hydrous Titanium Oxide dispersion, 0.97 times molar amounts of $Sr(OH)_2.8H_2O$ were added and placed in a reaction vessel made of SUS, and nitrogen gas was replaced. Further, distilled water was added so that the amount of $SrTiO_3$ was 0.6 mol/liter. The slurry in a nitrogen atmosphere was heated at 10° C./hour to 75° C. 8 hours reaction was carried out after reaching 75° C. After the reaction the slurry was cooled to room temperature and the supernatant liquid was removed, washing was repeated with pure water, and then filtration was performed with a Nutche, and the obtained cake was dried to obtain strontium titanate (4). SEM observation confirmed that Strontium titanate (4) have a cubic or rectangular parallelepiped particle shape. The number average particle diameter of strontium titanate (4) was 110 nm.

1-6-5. Preparation of Strontium Titanate (5)

A hydrous Titanium Oxide slurry obtained by hydrolyzing an aqueous solution of titanyl sulfate was washed with an aqueous alkali solution. Hydrochloric acid was then added to the slurry of the hydrous titanium oxide to adjust the pH to 0.65 to obtain a titania sol dispersion. NaOH was added to this titania sol dispersion to adjust the pH of the dispersion to 4.7, and the washing was repeated until the electric conductivity of the supernatant liquid became 50ρS/cm. To this hydrous Titanium Oxide dispersion, 0.97 times molar amounts of $Sr(OH)_2.8H_2O$ were added and placed in a reaction vessel made of SUS, and nitrogen gas was replaced. Further, distilled water was added so that the amount of $SrTiO_3$ was 0.6 mol/liter. The slurry in a nitrogen atmosphere was heated at 10° C./our to 55° C., 8 hours reaction was carried out after reaching 55° C. After the reaction the slurry was cooled to room temperature and the supernatant liquid was removed, washing was repeated with pure water, and then filtration was performed with a Nutche, and the obtained cake was dried to obtain strontium titanate (5). SEM observation confirmed that Strontium titanate (5) have a cubic or rectangular parallelepiped particle shape. The number average particle diameter of strontium titanate (5) was 8 nm.

1-7. Preparation of the Carrier 1-7-1. Preparation of Core Particles

MnO: 35.0 mol %

MgO: 14.5 mol %

$Fe_2O_3$: 50.0 mol %

SrO: 0.5 mol %

Each raw material was weighed so as to have the above amount ratio, mixed with water, and then pulverized by a wet media mill for 5 hours to obtain a slurry.

The resulting slurry was dried by spray dryer to obtain true spherical particles. After the particle size adjustment, the particles were heated for 2 hours at 950° C., and subjected to calcination in a rotary kiln. After grinding for 1 hours in a dry ball mill using stainless beads having a diameter of 0.3 nm, polyvinyl alcohol (PVA) as a binder of 0.8% by mass based on the solid content was added, and further, water and a polycarboxylic acid-based dispersant were added, and the mixture was ground using zirconia beads having a diameter of 0.5 cm for 30 hours. The obtained powder was granulated by a spray dryer, dried, and was subjected to main firing by holding for 15 hours in an electric furnace at a temperature of 1050° C.

The powder after firing was crushed and further classified to adjust the particle size, and then low-magnetic-force product was fractionated by magnetic force sorting to obtain core particles 1. The volume average particle diameter of the core particles 1 was 30 μm.

The volume average particle size of the core material particles is a value obtained by measuring by a wet method, using a laser diffractive particle size distribution measuring apparatus (manufactured by Nippon Laser Co., Ltd., HELOS). Specifically, first, select the optical system of the focal position 200 mm, and set the measurement time to 5 seconds. Then, the core particles for measurement were added to an aqueous solution of 0.2% by mass sodium dodecyl sulfate, and dispersed for 3 minutes using an ultrasonic cleaner (manufactured by asone Co., Ltd., US-1) to prepare a sample dispersion for measurement, which was fed into the laser diffraction type particle size distribution measuring device by several drops, and measurement was started when the sample concentration gauge reached the measurable region. Of the obtained particle size distribution was based on the particle size range (channel), the cumulative distribution was prepared from the small diameter side, and the volume average particle diameter was calculated based on the cumulative distribution.

1-7-2. Preparation of Coating Resin

In an aqueous solution of 0.3 mass % sodium benzenesulfonate, cyclohexyl methacrylate and methyl methacrylate in an amount having a mass ratio (copolymerization ratio) of 70:30 were added, and potassium persulfate in an amount of corresponding to 0.5% by mass of the total amount of monomers was added to perform emulsion polymerization, and the mixture was dried by spray drying to prepare a coating resin. The weight average molecular weight of the coating resin was 500,000.

1-7-3. Fabrication of the Carrier

A high-speed stirring mixer with a horizontal stirring blade was charged with 100 parts by mass of the prepared core particles and 4.5 parts by mass of the prepared coating resin, and mixed and stirred at 22° C. for 15 minutes under the condition that the peripheral speed of the horizontal rotating blade was Sm/sec, and then mixed and stirred at 120° C. for 50 minutes to coat the surface of the core particles with the coating resin by the action of a mechanical impact force (mechanochemical method), and then cooled to room temperature to produce a carrier.

1-8. Preparation of Toner for Electrostatic Charge Image Development 1-8-1. Preparation of Toner (1)

To 100 parts by mass of the toner base particles (1), 1.0 parts by mass of strontium titanate (1) and 1.5 parts by mass of silica (number average particle diameter:20 nm) were added and mixed in a Henschel mixer for 20 minutes Thereafter, the toner was mixed with the above carrier so that the toner concentration became 9% by mass, and mixed using a V-type mixer (manufactured by Tokushu Kogyo Seisakusho Co., Ltd.) for 30 minutes at 25° C. thereby obtained toner (1) as a toner for developing an electrostatic charge image (developer).

The number average particle size of the silica particles was obtained using a scanning electron microscope (SEM) (manufactured by Nippon Electronics Co., Ltd., JEM-7401F). SEM photograph enlarged at 50000 times is taken by a scanner, the image processing analyzer (Nileco Co., Ltd., LUZEX AP), and the silica particles of the SEM photographic image was subjected to a 2 valorization process and the horizontal Ferre diameter for 100 silica particles was calculated to obtain the number average particle size of the silica particles.

1-8-2. Preparation of Toner (2)

Toner (2) was obtained in the same manner as in the preparation of toner (1), except that toner base particles (2) were used instead of toner base particles (1).

1-8-3. Preparation of Toner (3)

Toner (3) was obtained in the same manner as in the preparation of toner (1), except that strontium titanate (2) was used instead of strontium titanate (1).

1-8-4. Preparation of Toner (4)

Toner (4) was obtained in the same manner as in the preparation of toner (1), except that strontium titanate (3) was used instead of strontium titanate (1).

1-8-5. Preparation of Toner (5)

Toner (5) was obtained in the same manner as in the preparation of toner (1), except that toner base particles (3) were used instead of toner base particles (1).

1-8-6. Preparation of Toner (6)

Toner (6) was obtained in the same manner as in the preparation of toner (1), except that toner base particles (4) were used instead of toner base particles (1).

1-8-7. Preparation of Toner (7)

A toner (7) was obtained in the same manner as in the preparation of the toner (1), except that the toner base particles (5) were used instead of the toner base particles (1).

1-8-8. Preparation of Toner (8)

Toner (8) was obtained in the same manner as in the preparation of toner (1), except that strontium titanate (4) was used instead of strontium titanate (1).

1-8-9. Preparation of Toner (9)

Toner (9) was obtained in the same manner as in the preparation of toner (1), except that strontium titanate (5) was used instead of strontium titanate (1).

1-8-10. Preparation of Toner (10)

Toner (10) was obtained in the same manner as in the preparation of toner (1), except that toner base particles (6) were used instead of toner base particles (1).

1-8-11. Preparation of Toner (11)

Toner (11) was obtained in the same manner as in the preparation of toner (1), except that toner base particles (7) were used instead of toner base particles (1).

1-8-12. Preparation of Toner (12)

Toner (12) was obtained in the same manner as in the preparation of toner (1), except that toner base particles (8) were used instead of toner base particles (1).

1-8-13. Preparation of Toner (13)

Toner (13) was obtained in the same manner as in the preparation of toner (1), except that toner base particles (9) were used instead of toner base particles (1).

1-8-14. Preparation of Toner (14)

Toner (14) was obtained in the same manner as in the preparation of toner (1), except that strontium titanate (1) was not added during mixing by a Henschel mixer, and the amount of silica added was clanged to 2.5 parts by mass instead.

1-8-15. Preparation of Toner (15)

Toner (15) was obtained in the same manner as in the preparation of toner (1), except that toner base particles (10) were used instead of toner base particles (1).

1-8-16. Preparation of Toner (16)

Toner (16) was obtained in the same manner as in preparation of toner (1), except that toner base particles (11) were used instead of toner base particles (1).

1-8-18. Preparation of Toner (17)

Toner (17) was obtained in the same manner as in the preparation of toner (1), except that toner base particles (12) were used instead of toner base particles (1).

Table 2 and Table 3 show the toner base particles used in the preparation of the toner (1) to the toner (17), the type of the pigment and the amount thereof (the amount of each pigment (parts by mass when the mass of the toner base particles is set to 100 parts by mass)), the type of the resin, and the type and the particle diameter of strontium titanate used as an external additive.

TABLE 2

| | Toner Base Particle | | | | | | | | | | | | | | |
|---|---|---|---|---|---|---|---|---|---|---|---|---|---|---|---|
| | | | | | | | | | | | Resin | | | | |
| | Base | | Pigment | | | | | | | | Crystal-line | Amorphous | External Additive Strontium Titanate | | |
| Toner | Particle | Dispersion | P1-2 | | P2 | | P1-3 | | P1-1 | | Resin | Resin | | | Particle |
| No. | No. | No. | Name | Parts | Name | Parts | Name | Parts | Name | Parts | Name | Name | No. | Type | diameter |
| (1) | (1) | (1) | PBr25 | 4.0 | PB15:3 | 2.5 | PV23 | 1.0 | PY155 | 2.5 | c1 | a1 | (1) | La-doped | 60 nm |
| (2) | (2) | (1) | PBr25 | 4.0 | PB15:3 | 2.5 | PV23 | 1.0 | PY155 | 2.5 | — | a1 | (1) | La-doped | 60 nm |
| (3) | (1) | (1) | PBr25 | 4.0 | PB15:3 | 2.5 | PV23 | 1.0 | PY155 | 2.5 | c1 | a1 | (2) | Non-doped (irregular) | 60 nm |
| (4) | (1) | (1) | PBr25 | 4.0 | PB15:3 | 2.5 | PV23 | 1.0 | PY155 | 2.5 | c1 | a1 | (3) | Non-doped (cubic) | 60 nm |
| (5) | (3) | (2) | PBr23 | 4.0 | PB15:3 | 2.5 | PV23 | 1.0 | PY155 | 2.5 | c1 | a1 | (1) | La-doped | 60 nm |
| (6) | (4) | (3) | PBr25 | 4.0 | PB15:3 | 2.5 | PV23 | 1.0 | PY180 | 2.5 | c1 | a1 | (1) | La-doped | 60 nm |
| (7) | (5) | (1) | PBr25 | 4.0 | PB15:3 | 2.5 | PV23 | 1.0 | PY155 | 2.5 | c1 | a1 + b1 | (1) | La-doped | 60 nm |
| (8) | (1) | (1) | PBr25 | 4.0 | PB15:3 | 2.5 | PV23 | 1.0 | PY155 | 2.5 | c1 | a1 | (4) | Non-doped (cubic) | 110 nm |
| (9) | (1) | (1) | PBr25 | 4.0 | PB15:3 | 2.5 | PV23 | 1.0 | PY155 | 2.5 | c1 | a1 | (5) | Non-doped (cubic) | 8 nm |
| (10) | (6) | (4) | PBr25 | 6.0 | PB15:3 | 4.0 | — | — | — | — | c1 | a1 | (1) | La-doped | 60 nm |
| (11) | (7) | (5) | PBr25 | 5.5 | PB15:3 | 3.5 | PV23 | 1.0 | — | — | c1 | a1 | (1) | La-doped | 60 nm |
| (12) | (8) | (6) | PBr25 | 4.5 | PB15:3 | 3.0 | — | — | PY155 | 2.5 | c1 | a1 | (1) | La-doped | 60 nm |

TABLE 3

| | Toner Base Particle | | | | | | | | | | | | | | |
|---|---|---|---|---|---|---|---|---|---|---|---|---|---|---|---|
| | | | | | | | | | | | Resin | | | | |
| | Base | | Pigment | | | | | | | | Crystal-line | Amorphous | External Additive Strontium Titanate | | |
| Toner | Particle | Dispersion | P1-2 | | P2 | | P1-3 | | P1-1 | | Resin | Resin | | | Particle |
| No. | No. | No. | Name | Parts | Name | Parts | Name | Name | Name | Parts | Name | Name | No. | Type | diameter |
| (13) | (9) | (7) | CB | 10.0 | — | — | — | — | — | — | c1 | a1 | (1) | La-doped | 60 nm |
| (14) | (1) | (1) | PBr25 | 4.0 | PB15:3 | 2.5 | PV23 | 1.0 | PY155 | 2.5 | c1 | a1 | — | — | — |
| (15) | (10) | (8) | — | — | PB15:3 | 6.5 | PV23 | 1.0 | PY155 | 2.5 | c1 | a1 | (1) | La-doped | 60 nm |

TABLE 3-continued

| | Toner Base Particle | | | | | | | | | | | | | | | |
|---|---|---|---|---|---|---|---|---|---|---|---|---|---|---|---|---|
| | | | | | | | | | | | | Resin | | | | |
| | Base | Pigment | | | | | | | | | | Crystal-line | Amorphous | External Additive Strontium Titanate | | |
| Toner | Particle | Dispersion | P1-2 | | P2 | | P1-3 | | P1-1 | | | Resin | Resin | | | Particle |
| No. | No. | No. | Name | Parts | Name | Parts | Name | Name | Name | Parts | | Name | Name | No. | Type | diameter |
| (16) | (11) | (9) | PBr25 | 6.5 | — | — | PV23 | 1.0 | PY155 | 2.5 | | c1 | a1 | (1) | La-doped | 60 nm |
| (17) | (1) | (10) | — | — | — | — | PV23 | 2.8 | PY155 | 7.2 | | c1 | a1 | (1) | La-doped | 60 nm |

2. Evaluation

For the image forming in the evaluation of the toner (1) to the toner (17), an evaluation device modified so that the surface temperature of the fixing heat roller of the image forming device (Konica Minolta Corporation, bizhub PRESS C1100) can be changed in the range of 80 to 180° C. was used. Each of the prepared toner and developer were filled into the toner cartridge and the developer, respectively, in this evaluation apparatus to be an image forming apparatus for evaluation.

2-1. Charging Property

Band-like solid images with a printing ratio of 5% were formed on the high-quality paper (65 g per m2) of the A4 plate at high-temperature and high-humidity (HH) (temperature 30° C. humidity 85% RH) ambient conditions and low-temperature and low-humidity (LL) (temperature 10° C., humidity 20% RH) ambient conditions, respectively. The amount of charge of the toner after printing 0.1 million sheets under each environment was measured, and by calculating the difference between the amount of charge under the LL environment and the amount of charge under the HH environment, the environmental difference A of the withstand voltage was measured. The charge amount is a value obtained by sampling a two components developer in a developer and measuring it using a blow-off charge amount measuring device (TB-200, manufactured by Toshiba Chemical Co., Ltd.). From the obtained environmental difference A of the withstand voltage, the charging property of each toner was evaluated by the following criteria. It can be judged that the smaller Δ, the better the charging property of the toner.

AA The environmental difference A of the charge amount of the toner is less than 8 μC/g.

A: The environmental difference A of the charge amount of the toner is 8 μC/g or more and less than 12 μm C/g.

B: The environmental difference A of the charge amount of the toner is 12 μC/g or more and less than 15 μC/g.

C: The environmental difference A of the charge amount of the toner is 15 μC/g or more.

2-2. Cleanability

In normal temperature and normal humidity (NN) (temperature 20° C. humidity 50% RH) ambient conditions, 0.5 million images were formed on the upper quality paper (65 g/m 2) of the A4 plate at an image area ratio of 10%. Subsequently, halftone images were output. After these images were formed, flaws on the photoreceptor and image failure of the halftone image were visually observed, and the cleanability of each toner was evaluated with the following criteria.

AA: There is no visible scratch on the surface of the photoreceptor, and no defect is observed in the halftone image.

A: Although there was a scratch on the surface of the photoreceptor, there was no noticeable scratch observed visually. No image defect corresponding to the photoreceptor generating is observed in the halftone image.

C: Visual observation of the surface of the photoreceptor clearly revealed the occurrence of scratches. The halftone image also shows the occurrence of image defects corresponding to the flaw.

2-3. Dielectric Tangent (Transferability)

2 g of each toner was molded by applying a load of 200 kgf/cm2 over 1 minutes to prepare a test piece having a disk shape of 40φ. For each specimen, a complex dielectric constant was measured at a frequency of 100 kHz in an environment at a temperature of 25° C. and a relative humidity of 50% RH, using an LCR meter (manufactured by WayneKerr, Inc., WITHESS-6000). Then, from the complex dielectric constant obtained, the dielectric loss tangent (tan δ=dielectric loss factor ε"/dielectric constant ε') was calculated. It can be judged that the smaller the tan δ, the smaller the scattering of the toner and the like, and the better the transfer property.

AA: The dielectric loss tangent is 0.015 or less.

A: The dielectric loss tangent is 0.015 or more and less than 0.03.

C: The dielectric loss tangent is greater than or equal to 0.03.

2-4. Fixability

In normal temperature and normal humidity (NN) (temperature 20° C., humidity 50% RH) ambient conditions, a solid image with a toner adhering amount of 10 g/m$^2$ was formed on an A4 size OK topcoat+(127.9 g/m$^2$) (manufactured by Oji Paper Co., Ltd.). At this time, the temperature of the pressure roller was set 20° C. lower than that of the fixing roller, and the surface temperature of the fixing roller was changed up to 140° C. while changing so as to increase in increments of 5° C. from 80° C. From the temperature at which the image began to settle, the fixability (low-temperature fixability) of each toner was evaluated according to the following criteria.

AA: The temperature at which the image begins to settle is below 120° C.

A: The temperature at which the image begins to fix is 120° C. or more and less than 150° C.

C: The temperature at which the image begins to settle is higher than 150° C.

2-5. Light Resistance

A solid image (2 cm×2 cm) with a toner adhering amount of 4.5 g/m$^2$ was formed on a J-paper paper. Using a xenon lamp (Xenon Weather Meter XL75, manufactured by Suga Testing Machine Co., Ltd.), an irradiation exposure test for 14 days was performed on the formed image under an irradiation condition of 70.000 lux under an in-bath temperature of 25° C. and a humidity of 50% RH. The color difference (ΔE00) between the color before starting the test and the color after the exposure test was measured using a fluorescence spectrodensitometer "FD7" (manufactured by Konica Minolta Co., Ltd.) (condition: observation light source D50, field of view 2°, filter M2, density ANSI T, measurement mode Reflectance). From the obtained color difference (ΔE00), the light resistance of each toner was evaluated on the basis of the following criteria. It can be judged that the smaller the color difference (ΔE0), the better the light resistance.

AA: Color difference (ΔE00) is less than 5.

A: Color difference (ΔE00) is 5 or more and less than 7.

B: Color difference (ΔE00) is 8 or more and less than 10.

C: Color difference (ΔE00) of 10 or more.

2.6. Reflectance (Infrared Transmittance)

A solid image (2 cm×2 cm) with a toner adhered amount of 4.5 g/m$^2$ was formed on an A4 size OK topcoat+(127.9 g/m$^2$) (manufactured by Oji Paper Co., Ltd.). A spectrophotometer (manufactured by Hitachi High-Tech Science Corporation. U 4100) was used to measure the reflectance spectra of the images with filter papers as a reference, and the reflectance in the near-infrared region around the wavelength of 800-1000 nm was measured. Reflectivity of each toner was evaluated by the following criteria from the obtained reflectance in the near infrared region. It can be judged that the higher the reflectance, less light absorption in the near-infrared region, and the higher the efficiency of near-infrared radiation transmittance.

AA: Reflectance in the near infrared region is 90% or more.

A: Reflectance in the near infrared region is 80% or more and less than 90%.

C: Reflectance in the tear infrared region is less than 80%.

Table 4 shows the evaluation results of toner (1 to toner (17).

TABLE 4

| | Toner No. | Charging Property | Cleanability | Dielectric Tangent | Fixability | Light Resistance | Reflectance |
|---|---|---|---|---|---|---|---|
| Working Example | (1) | AA | AA | AA | AA | AA | AA |
| Working Example | (2) | AA | AA | AA | A | AA | AA |
| Working Example | (3) | AA | A | AA | AA | AA | AA |
| Working Example | (4) | A | AA | AA | AA | AA | AA |
| Working Example | (5) | AA | AA | AA | AA | AA | A |
| Working Example | (6) | AA | AA | AA | AA | A | A |
| Working Example | (7) | AA | AA | AA | A | AA | AA |
| Working Example | (8) | B | A | AA | AA | AA | AA |
| Working Example | (9) | AA | A | AA | AA | AA | AA |
| Working Example | (10) | A | AA | AA | A | A | AA |
| Working Example | (11) | A | AA | AA | A | A | AA |
| Working Example | (12) | A | AA | AA | A | A | AA |
| Comparative Example | (13) | C | AA | C | C | AA | C |
| Comparative Example | (14) | C | C | A | AA | AA | C |
| Working Example | (15) | A | AA | AA | A | A | AA |
| Working Example | (16) | A | AA | AA | A | A | A |
| Working Example | (17) | A | AA | AA | A | B | A |

As is obvious from Table 4, the toners (1) to (12) and (15) to (17) containing the toner base particles containing the binder resin and at least two kinds of organic pigments, and the external additive containing strontium titanate attached to the surface of the toner base particles had a smaller amount of absorption of electromagnetic waves in the near infrared region than the toner (13) containing carbon black as the toner base particles, and were excellent in charging stability and cleanability.

In addition, the toners (1) to (12) and (15) to (17) containing the toner base particles containing the binder resin and at least two kinds of organic pigments, and the external additive containing strontium titanate attached to the surface of the toner base particles were superior in the amount of absorption of electromagnetic waves in the near infrared region and in charging stability and cleanability than the toner (14) which does not contain strontium titanate in the external additive.

In addition, the toners (1) to toners (12) containing a pigment P1-2 loving an absorption maximum wavelength λ max (nm) of 460 nm or more and 530 nm or less when dispersed in methyl ethyl ketone and a pigment P2 having an absorption maximum wavelength λ max (nm) of 600 nm or more and 700 nm or less when dispersed in methyl ethyl ketone were superior in charging stability and had higher light resistance of the formed image and less absorbed electromagnetic waves in the near infrared region than toners (15) and (16) which does not contain either or both of them.

In addition, the toners (1) to toners (9) which contains a pigment P1-1 having an absorption maximum wavelength λ max (nm) of greater than 400 nm and less than 460 nm when dispersed in methyl ethyl ketone or a pigment P1-3 having an absorption maximum wavelength λ max (nm) of greater than 530 nm and less than 600 nm when dispersed in methyl ethyl ketone, in addition to the pigment P1-2 and the pigment P2, were superior in charging stability and low-temperature fixability, and had a higher light resistance of the formed image and less absorbed electromagnetic waves in the near infrared region than toners (10) to (12) which does not contain any of them.

Further, the toners (1) to (7) whose particle diameter of the peak top in the number particle size distribution of strontium titanate was 10 nm or more and 100 nm or less was superior in cleanability than the toners (8) and (9) whose particle diameter was less than 10 nm or larger than 100 nm.

In addition, the toners (1) to (6) in which the content of the amorphous polyester resin was 0.1% by mass or more and 20% by mass or less based on the total mass of the binder resin were superior in the low-temperature fixability than the toner (7) in which the content of the amorphous polyester resin was larger than 20% by mass based on the total mass of the binder resin.

In addition, the toners (1) and (2) containing strontium titanate doped with lanthanum as an external additive were superior in the charge stability and the cleanability than toners (3) and (4) containing strontium titanate undoped with lanthanum as an external additive.

Further, the toner (1) containing the crystalline polyester resin was superior in low-temperature fixability than the toner (2) which does not contain crystalline polyester resin.

INDUSTRIAL APPLICABILITY

According to the present invention, there is provided a toner containing two or more kinds of pigments, which can form an image excellent in various characteristics required at the time of image formation and also excellent in various characteristics required for an image.

Although embodiments of the present invention have been described and illustrated in detail, the disclosed embodiments are made for purposes of illustration and example only and not limitation. The scope of the present invention should be interpreted by terms of the appended claims.

What is claimed is:

1. A toner for electrostatic charge image development comprising:

a toner base particle comprising a binder resin and at least two kinds of organic pigments; and strontium titanate as an external additive, wherein the toner is substantially free of carbon black, the at least two kinds of organic pigments comprise:

a pigment P1 having an absorption maximum wavelength λ max (nm) of greater than 400 nm and less than 600 nm when dispersed in methyl ethyl ketone; and a pigment P2 having an absorption maximum wavelength λ max (nm) of 600 nm or more and 700 nm or less when dispersed in methyl ethyl ketone, and the pigment P1 comprises a pigment P1-2 having an absorption maximum wavelength λ max (nm) of 460 nm or more and 530 nm or less when dispersed in methyl ethyl ketone.

2. The toner for electrostatic charge image development according to claim 1, wherein the pigment P1-2 comprises at least one pigment selected from the group consisting of C.I. Pigment Brown 23, C.I. Pigment Brown 25, C.I. Pigment Brown 41, and C.I. Pigment Red 38.

3. The toner for developing an electrostatic charge image according to claim 1, wherein the pigment P2 comprises at least one pigment selected from the group consisting of C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 15:5, C.I. Pigment Blue 15:6 and C.I. Pigment Blue 16.

4. The toner for developing an electrostatic charge image according to claim 1, further comprising a pigment P1-3 having an absorption maximum wavelength λ max (nm) of greater than 530 nm and less than 600 nm when dispersed in methyl ethyl ketone.

5. The toner for electrostatic charge image development according to claim 4, wherein the pigment P1-3 comprises at least one pigment selected from the group consisting of C.I. Pigment Orange 34, C.I. Pigment Orange 36, C.I. Pigment Orange 38, C.I. Pigment Orange 43, C.I. Pigment Orange 62, C.I. Pigment Orange 68, C.I. Pigment Orange 70, C.I. Pigment Orange 72, C.I. Pigment Orange 74, C.I. Pigment Red 31, C.I. Pigment Red 48:4, C.I. Pigment Red 57:1, C.I. Pigment Red 122, C.I. Pigment Red 146, C.I. Pigment Red 147, C.I. Pigment Red 150, C.I. Pigment Red 184, C.I. Pigment Red 238, C.I. Pigment Red 242, C.I. Pigment Red 254, C.I. Pigment Red 269, C.I. Pigment Violet 19, C.I. Pigment Violet 23, and C.I. Pigment Violet 32.

6. The toner for developing an electrostatic charge image according to claim 1, further comprising a pigment P1-1 having an absorption maximum wavelength λ max (nm) of greater than 400 nm and less than 460 nm when dispersed in methyl ethyl ketone.

7. The toner for electrostatic charge image development according to claim 6, wherein the pigment P1-1 comprises at least one pigment selected from the group consisting of C.I. Pigment Yellow 74, C.I. Pigment Yellow 120, C.I. Pigment Yellow 139, C.I. Pigment Yellow 151, C.I. Pigment Yellow 155, C.I. Pigment Yellow 180, C.I. Pigment Yellow 181, C.I. Pigment Yellow 185, C.I. Pigment Yellow 213, C.I. Pigment Green 7, C.I. Pigment Green 36, C.I. Pigment Green 254, and C.I. Pigment Orange 43.

8. The toner for developing an electrostatic charge image according to claim 1, wherein the strontium titanate includes lanthanum-doped strontium titanate.

9. The toner for developing an electrostatic charge image according to claim 1, wherein the strontium titanate has a particle diameter of a peak top in a number particle size distribution of 10 nm or more and 100 nm or less.

10. The toner for developing an electrostatic charge image according to claim 1, wherein the binder resin comprises a crystalline polyester.

11. An image forming method comprising;

adhering the toner for developing an electrostatic charge image according to claim 1 to a recording medium; and fixing the adhered toner for developing an electrostatic charge image to the recording medium.

12. The toner for developing an electrostatic charge image according to claim 1, wherein a total mass obtained by summing the pigment P1-2 and the pigment P2 is 60% by mass or more and 100% or less with respect to a total amount of the organic pigments.

* * * * *